US005329962A

United States Patent [19]

Ohnishi et al.

[11] Patent Number: 5,329,962

[45] Date of Patent: Jul. 19, 1994

[54] WEFT SUPPLY CHANGING AND THREADING APPARATUS

[75] Inventors: Kimimasa Ohnishi, Hachioji; Shuichi Kojima, Tokyo; Tokayuki Chikuma, Musashino, all of Japan

[73] Assignee: Nissan Motor Co., Ltd., Yokohama, Japan

[21] Appl. No.: 935,096

[22] Filed: Aug. 26, 1992

[30] Foreign Application Priority Data

Sep. 3, 1991 [JP] Japan ..... 3-222892
Sep. 19, 1991 [JP] Japan ..... 3-075277[U]
Sep. 20, 1991 [JP] Japan ..... 3-240931

[51] Int. Cl.[5] ..... D03D 47/34; D03J 1/12

[52] U.S. Cl. ..... 139/450; 242/164; 242/18 EW; 139/257

[58] Field of Search ..... 139/116.2, 256 A, 257, 139/450, 453; 242/164, 18 EW

[56] References Cited

U.S. PATENT DOCUMENTS 1,029,020 6/1912 Marazzi ..... 242/18 EW
2,944,414 7/1960 Malloy et al. ..... 139/450 X
3,420,467 1/1969 Bell ..... 242/164
5,107,905 4/1992 Shaw et al. ..... 139/450

FOREIGN PATENT DOCUMENTS 0346967 12/1989 European Pat. Off. .
0365472 4/1990 European Pat. Off. .
0448914A1 10/1991 European Pat. Off. .
2535025 3/1976 Fed. Rep. of Germany .
1-256468 10/1989 Japan .
7013797 4/1971 Netherlands ..... 139/450

*Primary Examiner*—Andrew M. Falik
*Attorney, Agent, or Firm*—Foley & Lardner

[57] ABSTRACT

A yarn supply system for a loom includes a yarn supply member changing apparatus for replacing a using yarn supply member with a new one when the weft yarn of the used yarn supply member has been used up or broken. The new yarn supply member is supplied to the yarn supply member changing apparatus at a mounting position from a self-propelled carriage. The new yarn supply member is carried to a yarn supply position by a carrying member movably mounted on the yarn supply member changing apparatus. A weft yarn wound on a bobbin forming part of the yarn supply member has a free tip end section which has been inserted into the central hole of the bobbin. The weft yarn tip end section of the yarn supply member at the yarn supply position of the yarn supply member changing position is drawn out of the bobbin and threaded into a weft winding arm forming part of a weft measuring and storing device under the influence of air stream. Thus, the weft yarn is supplied through the measuring and storing device to a weft inserting nozzle which projects the weft yarn into a warp yarn shed so as to accomplish a weft picking.

19 Claims, 21 Drawing Sheets

WEFT SUPPLY CHANGING AND THREADING APPARATUS

BACKGROUND OF THE INVENTION

1. Field of the Invention

This invention relates to a yarn supply system for automatically supplying a weft yarn to a downstream side device forming part of a loom, and more particularly to a yarn supply system including a yarn supply member changing apparatus for changing a used yarn supply member with a new one when the weft yarn of the used yarn supply member has been used up or broken.

2. Description of the Prior Art

A variety of yarn supply systems have been proposed and put into practical use. One of the known yarn supply systems is disclosed in Japanese Patent Provisional Publication No. 1-256468. This conventional yarn supply system will be discussed with reference to FIGS. 24 and 25.

FIG. 24 shows a yarn supply member provided with a tray, used in the above conventional yarn supply system. The yarn supply member A includes a hollow bobbin B which is formed opened at its upper and lower ends and which is frustoconical. A weft yarn W is wound on the bobbin B. A bobbin holder E has a central hole D and a frustoconical peripheral outer surface, and is extended vertically from the tray C. The yarn supply member A is installed on the tray C by fitting the bobbin B on the bobbin holder E from the upper side. The tip end section and the terminal end section of the weft yarn W are connected with each other and inserted into the central hole D of the bobbin holder B.

FIG. 25 Shows the above conventional yarn supply system. In this yarn supply system, a plurality of looms G are regularly arranged longitudinally and laterally to take a so-called matrix arrangement, at the loom area F in a weaving factory. A single conveyer I is arranged in a zigzag line. Rails J are respectively installed at a location between adjacent loom lines including the plural looms and at a location between the loom area F and the yarn supply member stock area H. A yarn supply member changing robot K is driven along the rails J. Here, the tray C provided with the yarn supply-member A as shown in FIG. 24 is supplied to the conveyer I at an empty and filled yarn supply member changing station L, and then moved to a transferring station M in the yarn supply member stock area H under the action of the conveyer I so as to be received by the yarn supply member changing robot K. Then, the yarn supply member changing robot K carries the yarn supply member A with the tray C to a weft yarn supply station N of the loom G which indicates the requiring of the yarn supply member an amount of weft yarn of the plural looms G which has been used up. When the yarn supply member changing robot K reaches the weft yarn supply station N, it cuts a portion at which the tip and terminal end sections are connected with each other, of the weft yarn W of the carried weft yarn supply member A. The tip end section of this new yarn supply member A is connected with the terminal end of the weft yarn of a yarn supply member (not shown) which is now being used, and then the new yarn supply member A is supplied to the weft yarn supply station N together with the tray C. Additionally, after an empty bobbin (not shown) whose yarn has been used up is collected together with the tray from the weft yarn supply station N, the empty bobbin with the tray is carried to an empty bobbin receiving station P in the stock area H and is removed to the conveyer I. The empty bobbin on this conveyer I is carried to the empty and filled yarn supply member changing station L at which the empty bobbin is collected together with the tray.

However, the above conventional yarn supply system requires a device, for accomplishing such a complicated operation, in which the tip end section of the weft yarn W of the new yarn supply member A is connected with the terminal end section of the weft yarn of the yarn supply member which is currently being used. Such an operation is made at the weft yarn supply station N of the loom G after cutting the weft yarn of the new yarn supply member at a part at which the tip and terminal end sections of the new yarn supply member are connected with each other.

SUMMARY OF THE INVENTION

It is an object of the present invention to provide an improved yarn supply system for a loom, which can effectively overcome drawbacks encountered in conventional yarn supply systems for a loom.

Another object of the present invention is to provide an improved yarn supply system for a loom, which does not require a device for accomplishing a complicated operation for connecting the tip end section of a weft yarn of a new yarn supply member with the terminal end section of a weft yarn of another yarn supply member which is now being used.

A further object of the present invention is to provide an improved yarn supply system for a loom, in which transferring of a weft yarn from a new yarn supply member to a downstream side device forming part of the loom is automatically accomplished at least partly under the influence of air stream.

A further object of the present invention is to provide an improved yarn supply system for a loom, in which the tip end section of a weft yarn is drawn out of a bobbin under the influence of air stream during transferring of the weft yarn from a new yarn supply member to a downstream side device forming part of the loom.

A yarn supply system according to the present invention is for a loom and comprised of a stand member for supporting at a yarn supply station a yarn supply member which includes a hollow core member and in a state in which a tip end section of a weft yarn wound on the core member has been inserted in the core member. Additionally, a device is provided to draw the weft yarn end section out of the hollow core member under the influence of air stream and to transfer it to a downstream side device forming part of the loom.

Accordingly, the weft yarn end section inserted in the hollow core member of the yarn supply member is drawn out under the influence of air stream and transferred to the downstream side device. This can omit such a complicated operation as to connect the tip end section of the weft yarn of a new yarn supply member with the terminal end of the weft yarn of a using yarn supply member after once being cut, thereby improving operational efficiency and simplifying the construction of the yarn supply system.

BRIEF DESCRIPTION OF THE DRAWINGS

In the drawings, same reference numerals designate corresponding elements and parts throughout all the figures, in which.

DETAILED DESCRIPTION OF THE INVENTION

Figure 3:
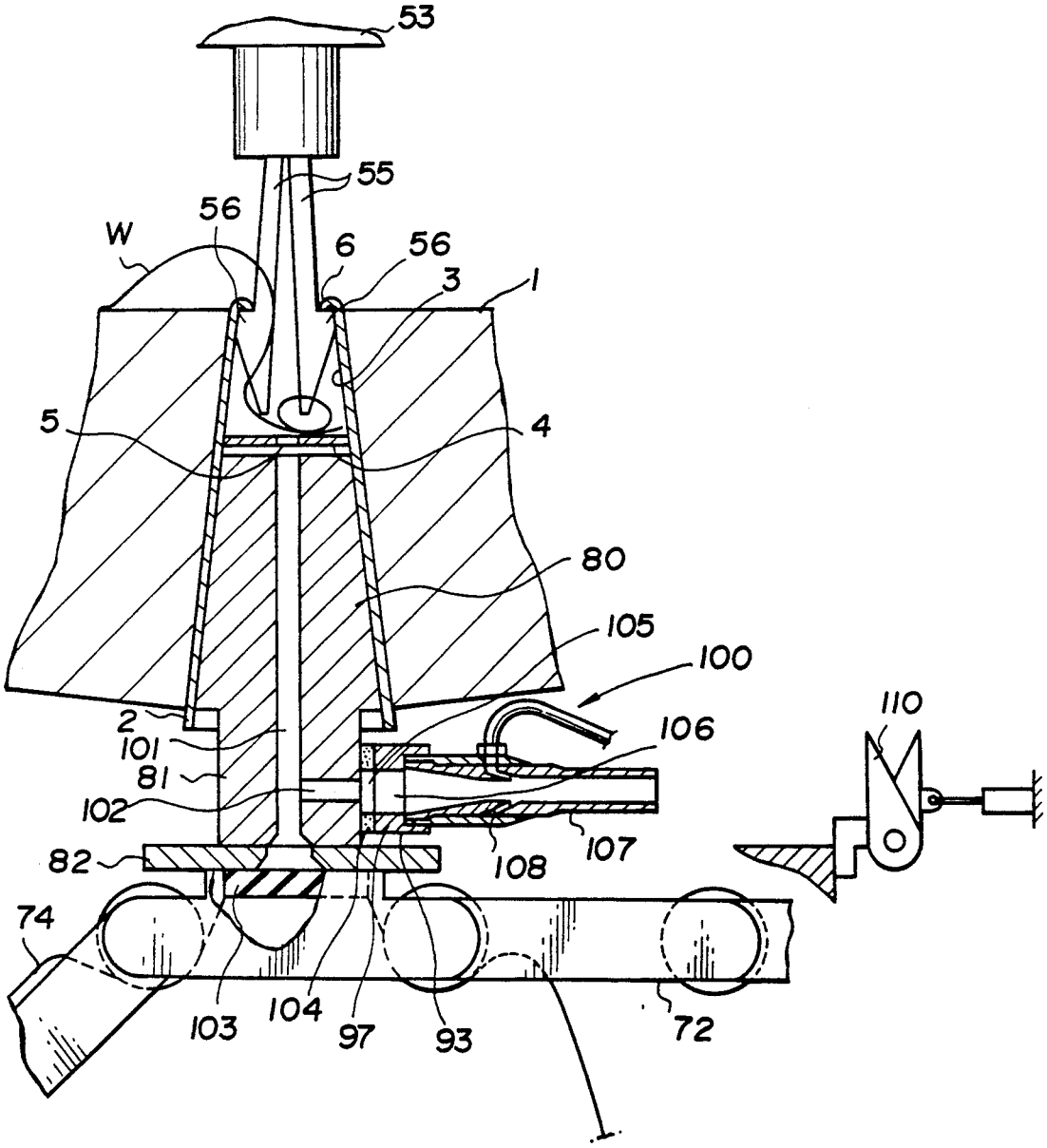
FIG. 3 is a fragmentary enlarged sectional view similar to FIG. 1 but showing a state in which the yarn supply member suspended from the holding hand is fitted on the bobbin holder.
Figure 4:
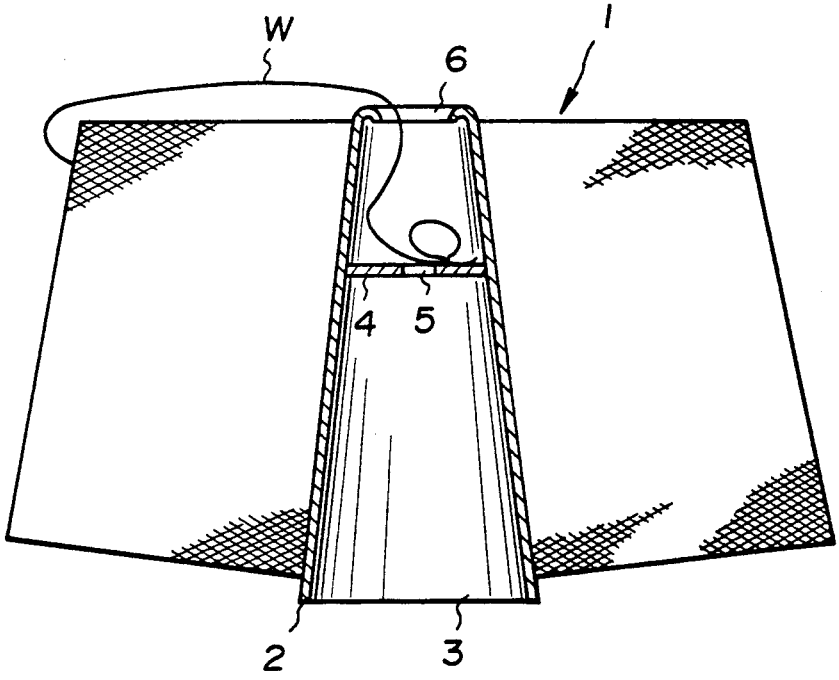
Fig. 4 is a cross-sectional view of the yarn supply member to be used in the yarn supply system of FIG. 1.
Figure 5:
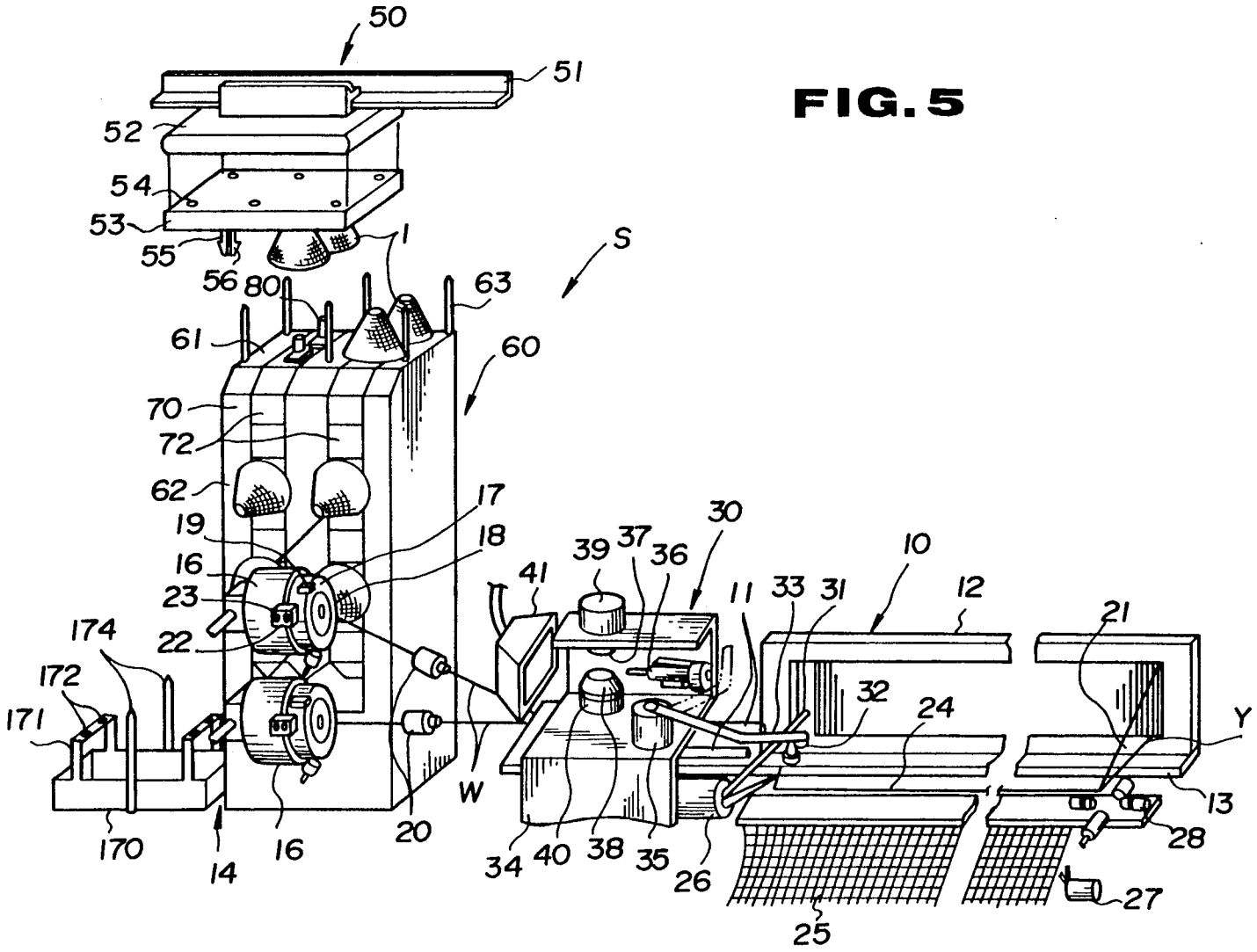
FIG. 5 is a perspective view of the yarn supply system of FIG. 1.
Figure 6:
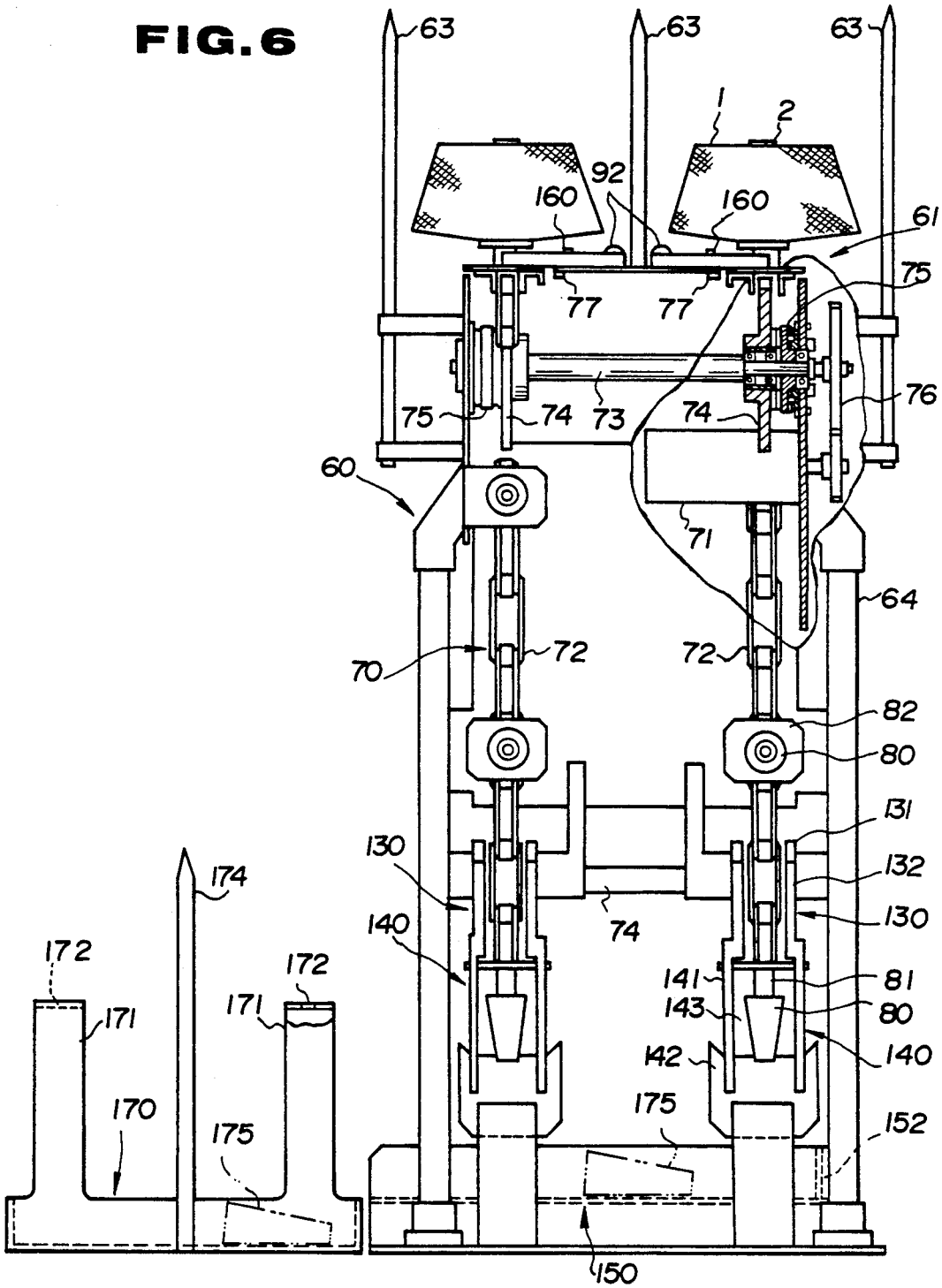
FIG. 6 is a front elevation of a yarn supply member changing apparatus of the yarn supply system of FIG. 5.
Figure 7:
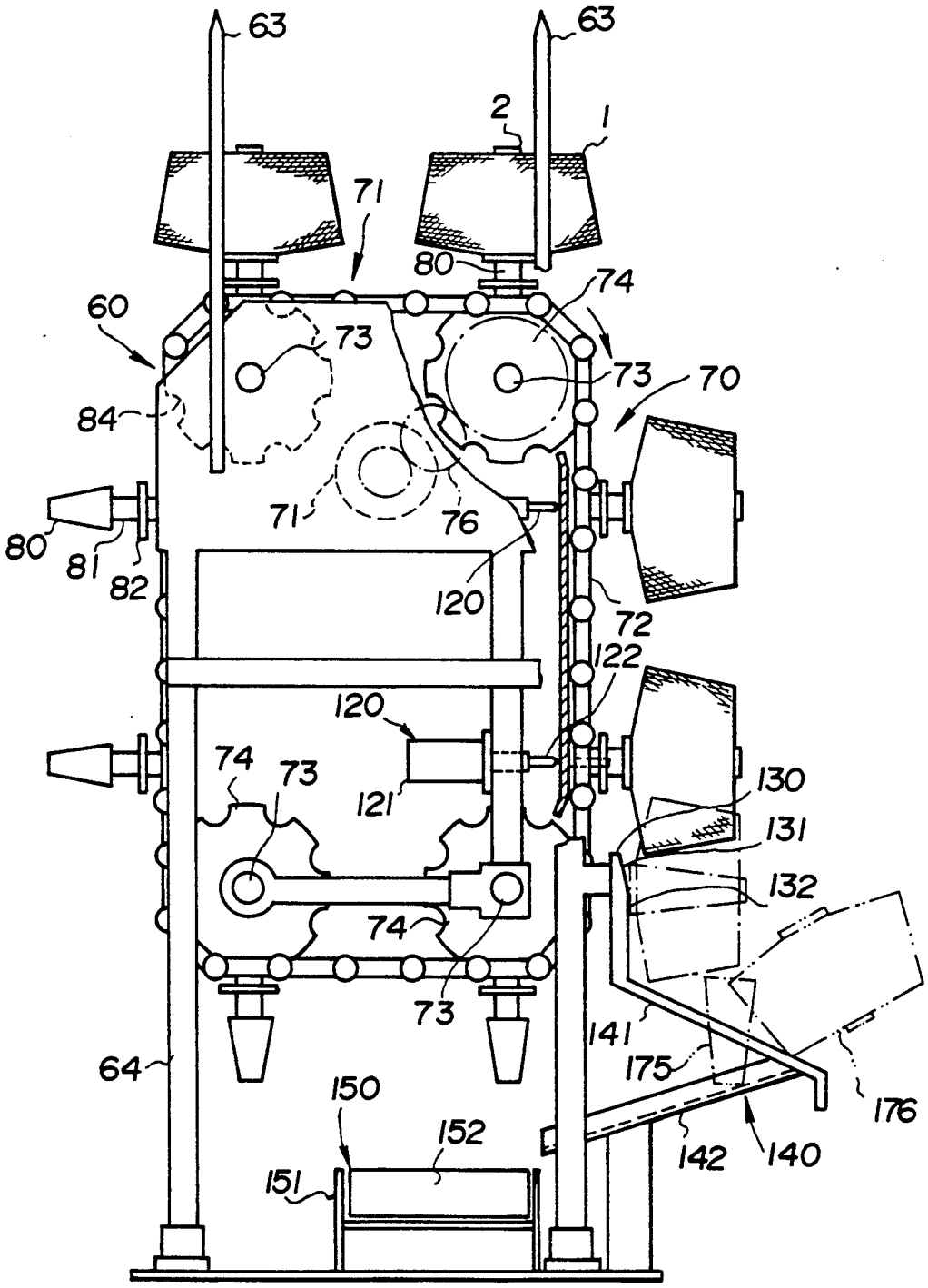
FIG. 7 is a side elevation of the yarn supply member changing apparatus of FIG. 6.

Referring now to FIGS. 1 to 9, and more specifically to FIG. 5, wherein an embodiment of a yarn supply system or yarn supply member changing system in accordance with the present invention is illustrated by the reference character S. In FIG. 5, the yarn supply member changing system S comprises a yarn supply member changing apparatus 60 for one of looms 10 located at a weaving loom area in a weaving factory. The yarn supply member changing system S shown in FIG. 5 is summarized as follows: A mobile or self-propelled carriage 50 carries a yarn supply member 1 from a station 14. The yarn supply member 1 is removed and supplied to a bobbin holder 80 of a carrying device 70 forming part of the yarn supply member changing device, at a mounting position (stand-by position) 61 residing at the upper surface of the yarn supply member changing apparatus 60 located at the weft yarn supply station 14. The yarn supply member changing apparatus 60 which has received the yarn supply member 1 from the mobile carriage 50 removes the yarn supply member 1 to a yarn supply position (used position) 62 at a vertically central part of the front face of the yarn supply member changing apparatus 60 under the action of the carrying device 70. Thereafter, a weft yarn W of the yarn supply member 1 is transferred to a weft measuring and storing device 16 as a downstream side device for the yarn supply member 1 under the influence of air stream. Additionally, an empty bobbin 175 (weft yarn is used up) as indicated in phantom in FIG. 7 and an unused yarn supply member 176 (weft yarn has not yet been used) as indicated in phantom in FIG. 7 are discharged out of the yarn supply member changing apparatus 60 at a removing position (not identified).

The yarn supply member 1 used in this embodiment is shown in FIG. 4. In FIG. 4, the yarn supply member 1 includes a bobbin (or hollow core member) 2 on which the weft yarn W is wound. The bobbin 2 is, for example, a hollow paper cylinder which is formed generally frustoconical and has opened upper and lower ends, forming an inside piercing hole 3. A disc-shaped middle plate 4 is fixedly disposed inside the bobbin 2 and located at a vertically central part of the piercing central hole 3 in such a manner as to be horizontal or perpendicular to the direction of the axis of the bobbin 2. The middle plate 4 is formed of a netting member which can prevent the weft yarn from passing therethrough such as a wire netting, or a plate member which is formed of plastic, metal or paper. In this embodiment, the middle plate 4 is formed of a paper plate and formed with a through-hole 5 at the central part thereof. The middle plate 4 is bounded at its peripheral section with the inner peripheral surface of the bobbin 2 defining the inside piercing hole 3 by means of adhesion. The tip end section of the weft yarn W wound on the bobbin 2 is inserted through a small-diameter upper end opening 6

(formed at the upper end) into the inside piercing hole 3 above the middle plate 4 so as to take a state to be mounted on the middle plate 4.

The yarn supply member changing system S will be more specifically discussed. Referring to FIG. 5, the loom 10 is a multiple color loom and therefore a plurality of weft inserting nozzles 11 are installed to a reed holder 13 together with a reed 12. The yarn supply member changing apparatus 60 is installed at the installation floor of the weft yarn supply station 14 on the side of the weft inserting nozzles of the loom 10. A ceiling (not shown) over the mounting position 61 of the yarn supply changing apparatus 60 is provided with a rail 51 along which the mobile carriage 50 moves throughout the weft yarn supply station 14 and the yarn supply member stock area. An empty bobbin basket 170 is disposed on the installation floor on the left side of the yarn supply 60 in order to store the empty bobbins 175 which have been used up in weft yarn W and which will be discharged out of the yarn supply member changing apparatus 60. A yarn supply member basket (not shown) is disposed on the installation floor in front of the yarn supply member changing apparatus 60 in order to store the unused yarn supply members 176 which will be discharged out of the yarn supply member changing apparatus 60 when the weft yarn thereon is cut or breaks. In front of the yarn supply position 62 of the yarn supply member changing apparatus 60, a plurality of so-called drum type weft measuring and storing devices 16 are fixedly installed above the installation floor through a stand (not shown) installed the installation floor, the number of the devices 16 being the same as that of the weft inserting nozzles 11.

In the loom 10, the weft yarns from the plural yarn supply members 1 located at the yarn supply position 62 of the yarn supply member changing apparatus 60 are threaded into weft winding arms 17 of the weft measuring and storing devices 16. Under the relative driven rotation of the weft winding arm 17 to a drum 18 of each weft measuring and storing device 16, the weft yarn W drawn from each of the plural yarn supply members 1 is wound on the drum 18 to accomplish measuring and storing of the weft yarn W. The tip end section of each weft yarn W stored on the corresponding drum 18 is engaged with each engaging pin 19 which has been inserted into the corresponding drum 18, and thereafter threaded into each of the plural weft inserting nozzles 11 through each of plural third boosters 20 interposed between the weft measuring and storing device 16 and the reed holder 13.

When a weft picking is made in the loom 10, either one of the engaging pins 19 is withdrawn from the corresponding drum 18, the corresponding one of the plural weft yarns W is unwound from the corresponding drum 18 upon cooperation of air ejection from the weft inserting nozzle 11 corresponding to the above withdrawn engaging pin, of the plural weft inserting nozzles 11. This unwound weft yarn W is picked into a warp yarn shed 21 under the influence of air stream from the corresponding weft inserting nozzle. A decision as to whether either one of the plural weft yarns W is picked at this weft picking is made according to a weaving pattern set in a controller (not shown) of the loom 10. At this weft picking, a non-contact type weft unwinding sensor 22 disposed near each drum 18 detects the weft yarn W wound from the drum 18. Meant by the non-contact type is a type wherein a detection is made without contacting the weft yarn W. Then, the withdrawn engaging pin 19 is inserted into the drum 18 thereby engaging with the weft yarn W, and then the weft winding arm 17 makes its relative driven rotation to the drum 18 to wind the weft yarn W drawn from the yarn supply member 1 on the drum 18 thus accomplishing the preparation for the next weft picking. At this time, a non-contact type winding amount sensor 23 disposed near each of the drums 18 detects the amount of the weft yarn W wound on the drum 18. When the thus detected winding amount of the weft yarn W reaches a predetermined winding amount which has been already set, the driven rotation of the weft winding arm 17 is stopped.

As mentioned above, when the engaging pin 19 is withdrawn from the drum 18, the reed 12 makes its beating-up operation, following the weft picking of the weft yarn W unwound from the drum 18 into the warp shed 21 under the air ejection from the weft inserting nozzle. Under this beating-up operation, the weft yarn W picked into the warp shed 21 is beaten up against the cloth fell 24 to cross with warp yarns Y up and down thereby weaving a fabric 25. Thereafter, the beaten up weft yarn W is cut by usually used cutters 26, 27 which are respectively disposed at a weft picking side and a counter weft picking side relative to the woven-fabric 25. The weft picking side is a side on which the weft inserting nozzles 11 are located, while the counter weft picking side is a side opposite to the weft picking side with respect to the woven fabric 25. A waste yarn cut out by the usually used cutter 27 on the counter weft picking side is removed by a yarn end section collecting device 28 disposed on the counter weft picking side relative to the cutter 27. Thus, these weft picking, beating-up operation and cutting are repeatedly carried out thereby forming the woven fabric 25.

A dragging and removing device 30 is disposed near the weft inserting nozzle of the loom 10 as shown in FIG. 5. The dragging and removing device 30 is arranged to remove the weft yarn W residing on a warp yarn (Y) side relative to the weft inserting nozzle 11 or a mispicked weft yarn (not shown) before the starting of operation of the loom 10 upon completion of threading a new warp yarn w into the weft inserting nozzle 11 from the yarn supply member changing apparatus 60.

The dragging and removing device 30 includes a cutter guide 31 which is adapted to support downwardly a portion of the weft yarn W located near the outlet of the weft inserting nozzle 11 when the weft yarn W is blown up under the air ejection from a blow-up nozzle 32, and to introduce the thus supported portion of the weft yarn W to a stationary blade of the cutter 26 on the weft inserting nozzle side along with the movement of the reed holder 13. This cutter guide 31 is provided to the stationary blade of the cutter 26 and extends from this stationary blade through a space over the reed holder 13 toward the reed 12 and parallel with the warp yarns Y.

The blow-up nozzle 32 forming part of the dragging and removing device 30 is adapted to blow up the weft yarn W upwardly at a position between the cutter guide 31 and the weft inserting nozzle side end of the warp yarn Y, for example, so that the weft yarn becomes parallel with the reed 12. The blow-up nozzle 32 is installed to the reed holder 13.

The dragging and removing device 30 includes a guide arm 33 which is connected to a bracket 34 installed to the reed holder 13. More specifically, an end section of the guide arm 33 is fixed mounted on the output shaft of an air motor 35 (as an actuator) fixedly attached to the bracket 34. The guide arm 33 makes its rotation around the output shaft of the air motor 35 under the driving action of the air motor 35 and stops its rotation. The guide arm 33 takes its normal stopping position near an air mover 36 and indicated in phantom, and its preparation stopping position on the cloth fell side relative to the blow-up nozzle 32 and indicated by solid lines.

The air mover 36 forming part of the dragging and removing device 30 is connected to a pressurized air supply device or air compressor (not shown) and adapted to eject air from an ejection opening (not shown) which is formed inside the air mover 36 and located at an axially intermediate part thereof thereby to generate a suction air stream at an inlet side of the air mover 36 and a dragging air stream at the outlet side of the air mover 36. Accordingly, the air mover 36 sucks the weft yarn W or the mispicked yarn (not shown) guided near the inlet of the air mover 36 upon the movement of the guide arm 33 from the preparation stopping position to the normal stopping position, and drags the thus sucked weft yarn W or the mispicked yarn (not shown) to the outlet side and guides it toward a pair of take-up rollers 37, 38 which are arranged up and down.

The take-up rollers 37, 38 forming part of the dragging and removing device 30 are arranged to drag the weft yarn W or the mispicked yarn (not shown) blown out from the air mover 36 in a manner that the yarn is wound on the peripheral surface of the take-up rollers 37, 38 upon being grasped between the opposite end surfaces of the take-up rollers 37, 38. The upper side take-up roller 37 of these take-up rollers 37, 38 is rotatably mounted on the operating rod of an air cylinder 39 as an actuator and of the type of being rotatable upon contacting with a moving member, whereas the lower side take-up roller 38 is fixedly mounted on the output shaft of an electric motor 40 (as an actuator) installed to the bracket 34 and of the type of being drivably rotatable by the motor 40. The upper side take-up roller 38 is vertically movable under the driving action of the air cylinder 39, so that the opposite end faces of the upper and lower side take-up rollers 37, 38 are contactable and rotatable together.

The dragging and removing device 30 includes a suction pipe 41 which sucks the weft yarn W or the mispicked yarn dragged by the take-up rollers 37, 38 and remove it out of the loom 10 upon the upward movement of the upper side take-up roller 38 under the driving operation of the air cylinder 39 so that the take-up rollers 37, 38 separate from each other up and down. The suction pipe 41 is installed to the bracket 34 at a position on the counter weft picking side relative to the take-up rollers 37, 38.

The mobile carriage 50 functions to carry the yarn supply member 1 from the yarn supply member stock area to the weft yarn supply station 14 for the loom 10 so as to supply it to the yarn supply member changing apparatus 60, and to collect the empty bobbins 175 discharged out of the yarn supply member changing apparatus 60. The mobile carriage 50 includes a carriage base 52 which is suspended from and runs along the rail 51. A movable plate 53 is suspended under and connected with the carriage base through wires (not identified) under the carriage base 52, and arranged to be vertically movable. The movable plate 53 is formed with six locationing holes 54 which vertically pass through the movable plate 53, in which central front and rear (two) locationing holes are positioned at a laterally central part of the movable plate 53, and left side front and rear (two) locationing holes and right side front and rear (two) locationing holes are respectively positioned at the left and right sides of the central front and rear locations holes at the same distance from the central front and rear locationing holes. The distance between the front and rear locationing holes is the same in the central, left side and right side locationing holes. Additionally, the dimensions of the respective locationing holes are the same. The movable plate 53 is provided at its lower part with four holding hands 55 which are respectively located at front and rear parts on the left side and at front and rear parts on right side of movable plate 53. The holding hands 55 is of the electomagnetically operated type.

These holding hands 55 are arranged as follows: In a condition in which all the locationing holes 54 are respectively fitted to all locationing pins extending upwardly from the upper face of the yarn supply member changing apparatus 60, the left side front and rear holding hands 55 correspond respectively vertically in location to left side front and rear (two) bobbin holders 80 of the carrying device 70 standing by at the mounting position 61 of the yarn supply member changing apparatus 60, while the right side front and rear holding hands 55 correspond respectively vertically in location to right side front and rear (two) bobbin holders 80 of the carrying device 70 standing by at the mounting position 61 of the yarn supply member changing apparatus 60.

In another condition in which the central front and rear locationing holes 54 are fitted respectively with the left side front and rear locationing pins 63 of the yarn supply member changing apparatus 60 while the right side front and rear locationing holes 54 are respectively fitted respectively with the central front and rear locationing pins 63 of the yarn supply member changing apparatus 60, the right side front and rear holding hands 55 correspond respectively vertically to the left side front and rear bobbin holders 80 standing by at the mounting position 61 of the yarn supply member changing apparatus.

In a further condition in which the central front and rear locationing holes 54 are fitted respectively with the right side front and rear locationing pins 63 of the yarn supply member changing apparatus 60 while the left side front and rear locationing holes 54 are respectively fitted with the central front and rear locationing pins 63 of the yarn supply member changing apparatus 60, the left side front and rear holding hands 55 correspond respectively vertically to the right side front and rear bobbin holders 80 standing by at the mounting position 61 of the yarn supply member changing apparatus.

In a further condition in which the central front and rear locationing holes 54 are respectively fitted with front and rear locationing pins 174 extending upwardly from the empty bobbin basket 170 and respectively located at the front and rear parts of the basket 170, all the holding hands 55 correspond respectively vertically to four holding holes 172 formed a pair of grips 171.

Figure 2:
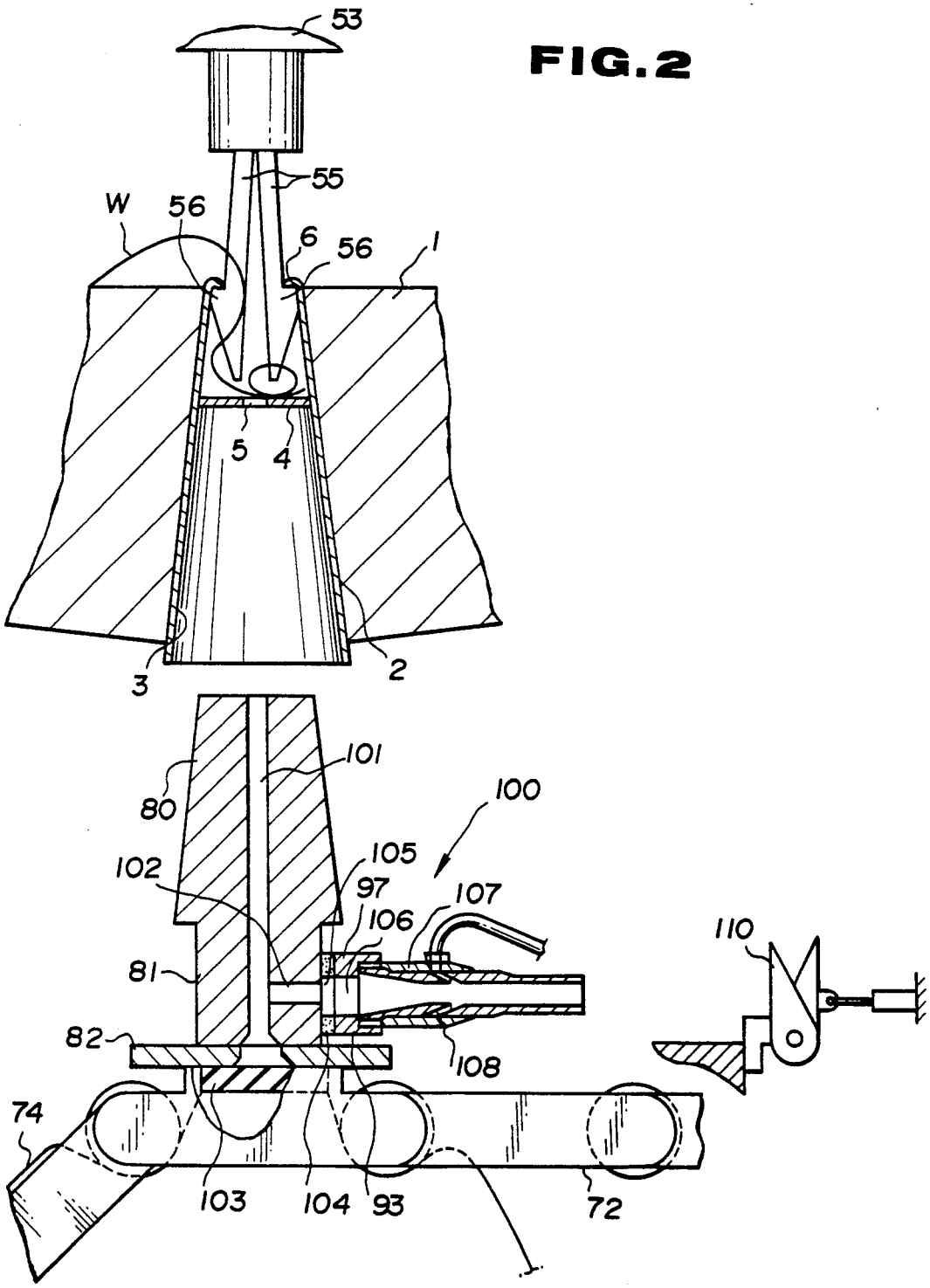
FIG. 2 is a fragmentary enlarged sectional view similar to FIG. 1 but showing a state in which a yarn supply member suspended from the holding hand is located above the bobbin holder.

Each holding hand 55 of the mobile carriage 50 includes a pair of generally parallel extending members (shown but not identified) which can separate from each other to take an open state of the holding hand 55 and approach each other to take a closed state of the holding hand 55. For the purpose of simplicity of illustration, the operation of the holding hand 55 will be described simply as opening or being opened to take the open state and as closing or being closed to take a closed state. In the yarn supply member stock area, the mobile carriage 50 causes each holding hand 55 in the closed state to be inserted through the upper end opening 6 into the inside piercing hole 3, and thereafter causes each holding hand 55 to open radially outwardly of the bobbin 2 so as to take the open state in which claw portions 56 formed at the tip section of the holding hand 55 are engaged with the lower face of an inner peripheral portion of the bobbin 2 defining the upper end opening 6 as shown in FIG. 2. Accordingly, the mobile carriage 50 catches a plurality of the yarn supply members 1 at its movable plate 53 in a manner that the yarn supply members 1 are suspended from the left side front and rear parts of the movable plate 53 or in another manner that the yarn supply members 1 are suspended from the right side front and rear parts of the movable plate 53 as shown in FIG. 5.

Turning back to FIG. 5, in order to supply the yarn supply members 1 caught at the yarn supply member stock area by the mobile carriage 50 to the yarn supply member changing apparatus 60, the mobile carriage 50 from the yarn supply member stock area is stopped at a predetermined stopping position above the mounting position of the yarn supply member changing apparatus 60 in response to a yarn supply member supply requirement signal (representing a requirement for supply of the yarn supply member) from a watching device (not shown) installed in a central control room (not shown). Thereafter, the movable plate 53 is moved downward and toward the mounting position 61 of the yarn supply member changing apparatus 60. As the movable plate 53 is moved downwardly, all the locationing holes 54, the central and left side (four) locationing holes 54, or the central and right side (four) locationing holes 54 are fitted with all the locationing pins 63, the central and right side (four)locationing pins 63, or the central and left side (four) locationing pins 63 of the yarn supply member changing apparatus 60. Simultaneously, the bobbins 2 of the yarn supply members 1 are fitted on all the bobbin holders 80, the left side two bobbins holders 80, or the right side two bobbin holders 80 of the carrying device 70 which bobbin holders are standing by at the mounting position 61 of the yarn supply member changing apparatus 60. Then, the bobbins 2 of the yarn supply members 1 are pressed on the bobbin holders 80 with the holding hands 55, and the downward movement of the movable plate 53 is stopped when the movable plate 53 has downwardly moved a predetermined distance toward the yarn supply member changing apparatus 60. After each holding hand 55 closes radially inwardly of the bobbin 2 to take the closed state, the movable plate 53 is moved upwardly a predetermined distance over the yarn supply member changing apparatus 60 and is stopped in its upward movement, thereby completing the removal of the yarn supply members 1 to the bobbin holders 80 of the carrying device 70 standing by at the mounting position 61 of the yarn supply member changing apparatus 60.

In order to collect the empty bobbins 175 by the mobile carriage 50, the mobile carriage 50 moving along the rail 51 stops at a stopping position above the empty bobbin basket 170 in response to an empty bobbin collecting signal (representing a requirement for collecting the empty bobbins) from the watching device. After stopping of the mobile carriage 50, the movable plate 53 is moved downwardly toward the empty bobbin basket 170. As the movable plate 53 is moved downwardly, the central front and rear locationing holes 54 are fitted respectively with the locationing pins 174 of the empty bobbin basket 170 so that all the holding hands 55 of the movable plate 53 are inserted respectively into all the holding holes 172 of the empty bobbin basket 170. When the movable plate 53 is moved downwardly a predetermined distance toward the empty basket 170, the downward movement of the movable plate 53 is stopped. After each of all the holding hands 55 is opened radially outwardly of each holding hole 172, the movable plate 53 is moved upwardly so that the claw portions 56 of each holding hand 55 are engaged with the lower face of a peripheral portion defining the holding hole 172. Accordingly, the empty bobbin basket 170 is suspended by the holding hands 55. When the movable plate 53 is moved upwardly the predetermined distance, the movable plate 53 is stopped in upward movement and moved toward an empty bobbin recovery station in the yarn supply member stock area.

In the yarn supply member changing apparatus 60 shown in FIG. 5, a plurality of carrying members 72 forming part of the carrying device 70 are moved together or independently in response to a yarn supply member changing requirement signal (representing a requirement of replacing a yarn supply member at the yarn supply position 62 with a new one) from the watching device, so that the yarn supply members 1 supplied from the movable carriage 50 are transferred from the mounting position to a yarn supply position 62. When the yarn supply member 1 reaches the yarn supply position 62, the movement of the carrying member 72 is stopped. At this yarn supply position 62, the tip end section of the weft yarn W of the yarn supply member 1 is blown out of the bobbin 2 under the action of air stream ejected from the inside of the bobbin holder 80 so that the weft yarns W from the yarn supply members 1 are transferred together or independently to the plural weft measuring and storing devices 16.

In FIGS. 6 and 7 illustrating the front and side sections of the yarn supply member changing apparatus 60, the carrying device 70 is arranged as follows: The plural carrying members 72 are driven or stopped together or independently by an electric motor 71 installed to a frame or stand member 64 which is formed vertically elongate and generally of the rectangular parallelepiped. More specifically, the carrying device 70 includes four shafts 73 which are rotatably supported by the frame 64 and extend laterally and in the direction of the left to right sides, in which two shafts 73 are located at the front and rear parts on the upper side of the frame 64 while two shafts 73 are located at the front and rear pans on the vertically intermediate section of the frame 64. A plurality of sprockets 74 are mounted on each of these shafts 73 in a manner that they are axially separate from each other by a predetermined distance.

In this embodiment, the loom 10 is of the multiple color type wherein two kinds of weft yarns are used. Accordingly, the two carrying members 72 are arranged in two rows and therefore the two sprockets 74 are mounted on each shaft 73. In FIG. 6, an endless chain forming part of the left side carrying member 72 is engaged on the left side sprocket 74 and arranged generally rectangular in the side view of FIG. 7. The endless chain includes a plurality of rollers and link plates. Another endless chain forming part of the right side carrying member 72 is engaged on the right side sprocket 74 in FIG. 6 and arranged generally rectangular in the side view, similarly to the left side carrying member 72. Furthermore, the sprockets 74 on the upper and front side shaft 73 are respectively mounted on the shaft 73 through electromagnetic clutches 75. An end section of this upper and front side shaft 73 is connected with the output shaft of an electric motor 71 through a power transmission mechanism 76 such as gears. The electromagnetic clutch 75 makes its ON operation to transmit the power of the shaft 73 to the sprocket 74 in response to the yarn supply member changing requirement signal, and makes its OFF operation to interrupt the power transmission from the shaft to the sprocket 74 in response to a signal which is produced when a stopping position sensor 77 of the non-contact type such as a proximity switch detects an iron piece (dog) disposed between the adjacent bobbin holders 80 of the carrying member 72.

Accordingly, in a condition the motor 1 makes its rotation for driving, when the left side electromagnetic clutch 75 in FIG. 6 makes its ON operation, the power of the motor 71 is transmitted to the left side sprocket 74 through power transmission mechanism 76, the shaft 73 and the left side electromagnetic clutch 75. Under the drive of this left side sprocket 74, the left side carrying member 72 moves circularly in a direction indicated by an arrow in FIG. 7 along the generally rectangular shape in the side view. When the right side electromagnetic clutch 75 in FIG. 6 makes its ON operation in a condition the motor 71 is making its rotation for driving, the power of the motor 71 is transmitted to the right side sprocket 74 through the power transmission mechanism 76, the shaft 73 and the right side electromagnetic clutch 75. Under the drive of this right side sprocket 74, the right side carrying member 72 moves circularly in the direction indicated by the arrow in FIG. 7 along the generally rectangular shape in the side view.

Thus, the plural electromagnetic clutches 75 function to simultaneously or independently transmit the power of one motor 71 to the plural sprockets 74 located at the upper and front side of the frame 64, or to simultaneously or independently interrupt the power transmission to the plural sprockets 74, according to its 0N and OFF operation. This causes the plural carrying members 72 to move or stop simultaneously or separately, so that some of the plural bobbin holders 80 installed at equal distances on each of the plural carrying member 72 are successively positioned to the mounting position and to the yarn supply position 62.

As shown in FIG. 6, the bobbin holder 80 is of the frustoconical shape wherein the outer diameter of the bobbin holder gradually decreases in a direction from the base end toward the tip end of the bobbin holder 80. The larger diameter base end of the bobbin holder 80 is provided with a shaft section 81 whose diameter is smaller than that of the base end. This shaft section 81 is integral with and extending from a base plate 82 installed to the outside edge of some link plates of each of the plural carrying members 72.

Figure 8:
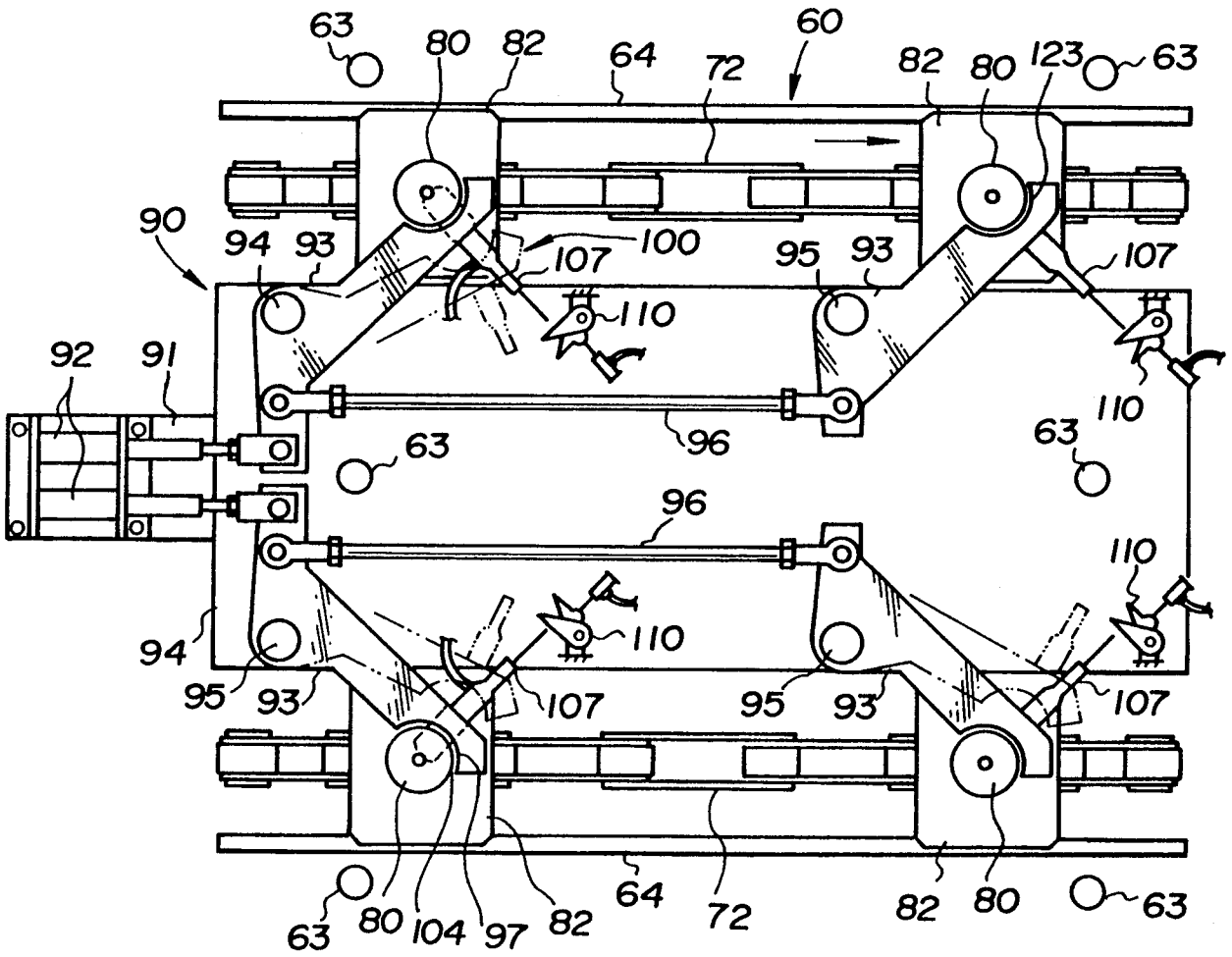
FIG. 8 is a plan view of the yarn supply member changing apparatus of FIG. 6.
Figure 9:
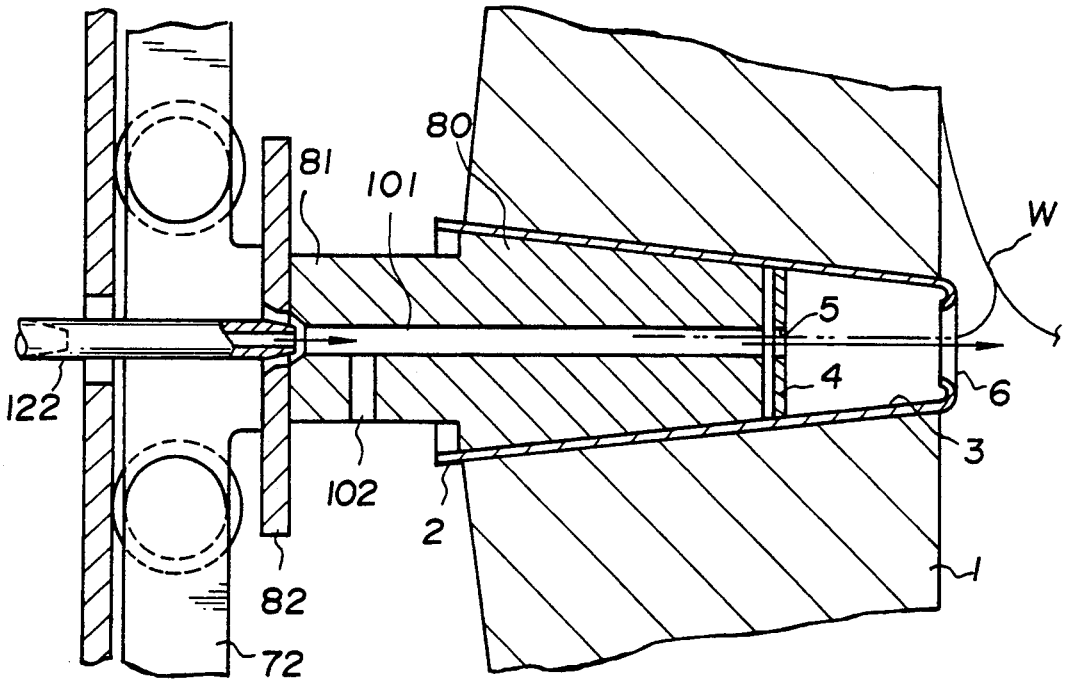
FIG. 9 is a cross-sectional view showing a state in which the tip end section of the weft yarn is blown out of the bobbin under the influence of air stream ejected from the inside of the bobbin holder, in the air supply system of FIG. 5.

In FIG. 8 illustrating the upper side of the yarn supply member changing apparatus 60, the yarn supply member changing apparatus 60 is provided with a locationing device 90, a suction air stream generating device 100 and a cutter 110.

As shown in FIG. 8, the locationing device 90 functions to precisely accomplish receiving of the yarn supply member 1 supplied from the mobile carriage 50 by the bobbin holder 80 standing by at the mounting position 61 of the yarn supply member changing apparatus 60, and transmission of the weft yarn W to the weft measuring and storing device 16 from the yarn supply member 1 installed on the bobbin holder 80 standing by at the yarn supply position 62 of the yarn supply member changing apparatus 60. To achieve the above, a plurality of locationing levers 93 are operated by a plurality of pneumatic or hydraulic cylinders installed to a bracket 91 disposed at the upper section of the frame 64, thereby accomplishing the locationing of a plurality of bobbin holders 80 at the mounting position 61 and the yarn supply position 62.

In this embodiment, since the plural carrying members 72 are arranged to be separately moved or stopped, one cylinder 92 operates the plural locationing levers 93 corresponding to the plural bobbin holders 80 of one carrying member 72 while the other cylinder 92 operates the plural locationing levers 93 corresponding to the plural bobbin holders 80 of the other carrying member 72.

More specifically, the plural locationing levers 93 corresponding to the bobbin holders 80 of one (fight side in FIG. 8) of the carrying members 72 are separately and horizontally swingably installed through pivot shafts 95 on a base plate 94 disposed between the carrying members 72 and located at the upper part of the frame 64. These locationing levers 93 are connected at their base end sections with each other through a connecting member 96 which is adjustable in length. The base end section of one locationing lever 93 (of these locationing levers 93) located rear in a direction indicated by an arrow in FIG. 8 is connected to the operating rod of one cylinder 92. Accordingly, under the extension operation of the one cylinder 92, the locationing levers 93 are moved around the pivot shafts 95 and to their holding positions indicated by solid lines in FIG. 8. As a result, the holding sections 97 of the respective locationing levers 93 are brought into close contact with the shaft sections 81 of the bobbin holders 80 which are adjacent to each other in the direction of movement of the carrying member 72 at the mounting positions 61 as shown in FIG. 2 thereby accomplishing the locationing of the bobbin holders 80. The holding section 97 is formed generally C-shaped at the tip end section of each locationing lever 93. Under the contraction operation of the one cylinder 92, the locationing levers 93 are respectively swingingly moved around the pivot shafts 95 and to stand-by positions indicated in phantom in FIG. 8, so that the holding sections 97 of the locationing levers 93 are separated from the shaft sections 81 of the bobbin holders 80 which are adjacent to each other in the movement direction of the carrying member 72 thereby releasing the locationing of the bobbin holders 80.

Similarly to the above, the plural locationing levers 93 corresponding to the bobbin holders 80 corresponding to the other (left side in FIG. 8) of the carrying members 72 are separately and horizontally swingably installed through pivot shafts 95 (separate from the above-mentioned) on a base plate 94 disposed between the carrying members 72 and located at the upper part of the frame 64. These locationing levers 93 are connected at their base end sections with each other through a connecting member 96 (separate from the above-mentioned) which is adjustable in length. The base end section of one locationing lever 93 (of these locationing levers 93) located rear in a direction indicated by an arrow in FIG. 8 is connected to the operating rod of one cylinder 92. Accordingly, under the extension operation of the other cylinder 92, the locationing levers 93 are moved around the pivot shafts 95 and to their holding positions indicated by solid lines in FIG. 8. As a result, the holding sections 97 of the respective locationing levers 93 are respectively brought into close contact with the shaft sections 81 of the bobbin holders 80 which are adjacent to each other in the direction of movement of the carrying member 72 at the mounting positions as shown in FIG. 2 thereby accomplishing the locationing of the bobbin holders 80. The holding section 97 is formed generally C-shaped at the tip end section of each locationing lever 93. Under the contraction operation of the other cylinder 92, the locationing levers 93 are respectively moved around the pivot shafts 95 and to the stand-by positions indicated in phantom in FIG. 8, so that the holding sections 97 of the locationing levers 93 are separated from the shaft sections 81 of the bobbin holders 80 which are adjacent to each other in the movement direction of the carrying member 72 thereby releasing the locationing of the bobbin holders 80.

Each of the plural locationing levers 93 stopped at their stand-by positions is arranged not to be interfere with the shaft section 81 of each bobbin holder 80 during movement of the carrying member 72.

Figure 1:
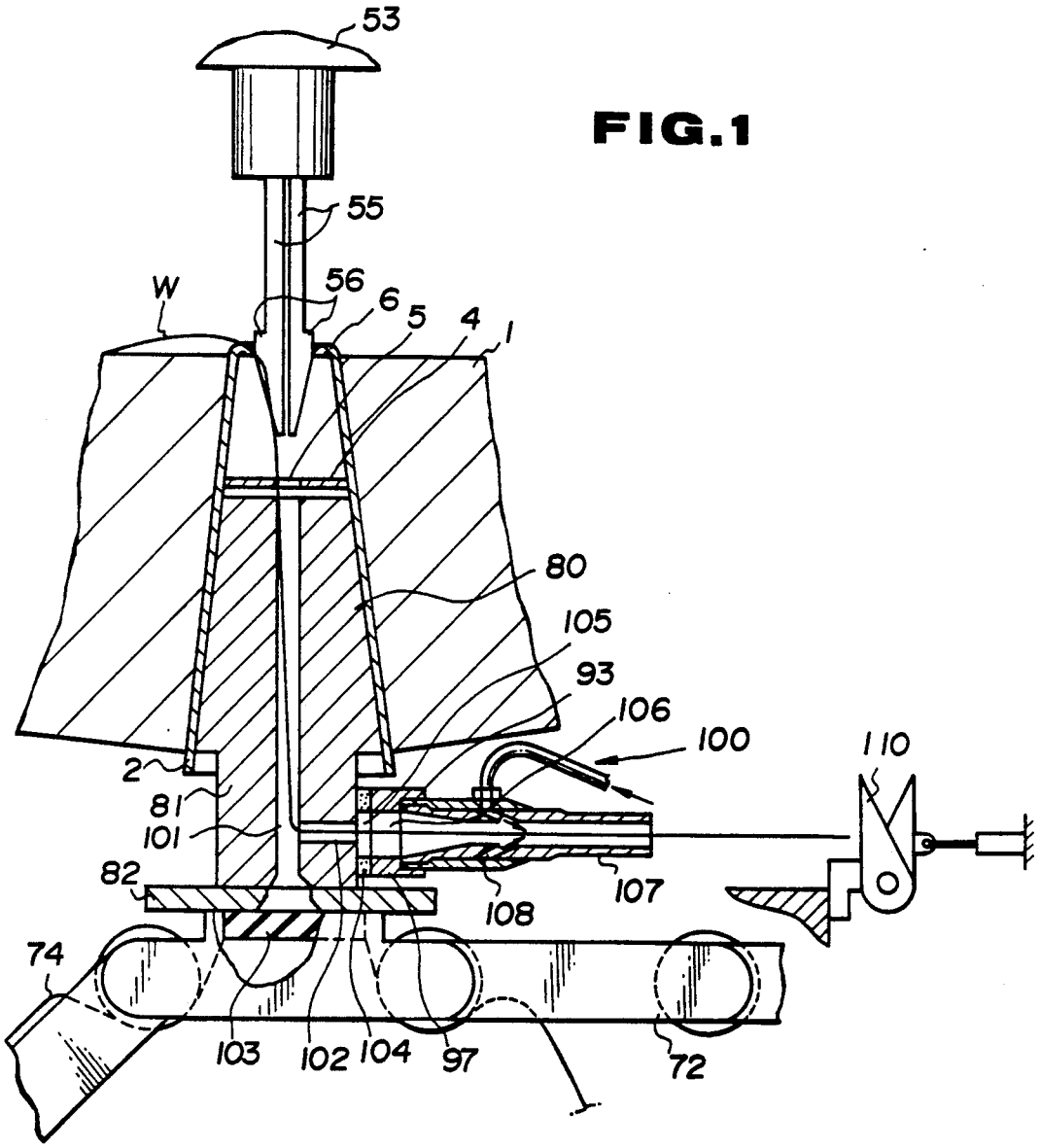
FIG. 1 is a fragmentary enlarged sectional view showing a part of an embodiment of a yarn supply system according to the present invention and shows a state in which a holding hand is drawn out of a bobbin upon the tip end section of a weft yarn being kept inside the bobbin under the influence of air stream generated inside a bobbin holder.

As shown in FIG. 2, the suction air stream generating device 100 constitutes means for generating a suction air stream inside the bobbin holder 80 when the yarn supply member 1 is supplied to the bobbin holder 80 standing by at the mounting position of the yarn supply member changing apparatus 60. The suction air stream generating device 100 includes a booster 107 fixedly attached to the holding section 97 of each locationing lever 93 and arranged as follows: A vertical hole or passage 101 is formed throughout each bobbin holder 80, each shaft section 81 and the base plate 82 along the axes thereof. A lateral hole 102 is communicated with the vertical hole or passage and formed radially in the shaft section 81 of each bobbin holder 80. A closing member 103 is attached to a tooth (corresponding to the base plate 82) of the teeth of the sprocket 74 mounted at the front upper and rear parts of the frame 64. The closing member 103 being formed of an elastomeric material such as rubber and attached to the tooth by means of adhesion. A through-hole 105 is formed in a seal member 104 which is formed of an elastomeric material such as rubber. The seal member 104 is attached to the holding section 97 of each locationing lever 93. A through-hole 106 is formed at the holding section 97 of each locationing lever 93 and communicated with the booster 107. The through-holes 105, 106 and the inlet of the booster 107 are arranged coaxial and communicated with each other. In a state where the locationing of the bobbin holders 80 is made under the action of the locationing device 90, a sealing contact is made between the shaft section 81 and the holding section 97 of the locationing lever 93 under the action of the seal member 104, so that the through-holes 105, 106 and the inlet of the booster 107 are communicated with the lateral hole 102. The booster 107 is connected to a pressurized air supply device or air compressor (not shown) and formed with an ejection opening 108 which is located at an axially intermediate part of the booster 107 as shown in FIG. 1. Air is ejected from the ejection opening 108 in a direction indicated by an arrow in FIG. 1, so that a suction air stream is generated at the inlet side of the booster 107 while a dragging air stream is generated at the outlet side of the booster 107.

As shown in FIG. 1, the suction air stream generating device 100 is operated as follows: Air is ejected from the ejection opening 108 of the booster 107 in a condition in which (a) the bottom opened part of the vertical hole 101 of the bobbin holder 80 standing by at the mounting position of the yarn supply member changing apparatus 60 is sealingly closed with the closing member 103; (b) the bobbin holder 80 is positioned by the locationing lever 93 of the locationing device 90; and (c) the bobbin holder 80 is supplied with the yarn supply member 1 from the mobile carriage 50. The suction air stream generated in the booster 107 causes a suction air stream also in the vertical and lateral holes 101, 102 of the bobbin holder 80 and in the inside piercing hole 3 of the bobbin 2, so that the tip end section of the weft yarn W on the middle plate 4 is sucked from the through-hole 5 into the booster 107 via the vertical hole 101, the lateral hole 102, the through-hole 105 and the through-hole 106. The thus sucked weft yarn tip end section is dragged to the outlet side of the booster 107. The weft yarn tip end section projected from the outlet of the booster 107 under the dragging is cut by a cutter 110 for the purpose of facilitating the transferring of the weft yarn W to the weft measuring and storing device 16.

As shown in FIG. 8, this cutter 110 is disposed separate from the booster 107 and at a position lying on the axial direction of the booster 107 and facing the outlet of the booster in a condition the locationing of the bobbin holder 80 has been completed by the locationing device 90. The cutter 110 is arranged not to interfere with the booster 107 even after the locationing device 90 releases the locationing for the bobbin holders 80.

Again turning back to FIGS. 6 and 7, the yarn supply member changing apparatus 60 is further provided with a yarn ejecting device 120, an empty bobbin and unused yarn supply member removing device 130, an empty bobbin and unused yarn supply member separating device 140, an empty bobbin temporarily storing device 150 and a yarn supply member sensor 160.

As shown in FIGS. 6 and 7, the yarn ejecting device 120 is adapted to blow out (from the inside of the bobbin 2) the tip end section of the weft yarn W of the yarn supply member 1 on the bobbin holder 80 at the yarn supply position 62 of the yarn supply member changing apparatus 60 under the influence of air stream ejected from the bobbin holder 80 thereby transferring the weft yarn tip end section to the weft measuring and storing device 16 as shown in FIG. 5. The yarn ejecting device 120 includes a plurality of air cylinders 121 attached to the frame 63, the number thereof being the same as that of the carrying members 72. The yarn ejecting device 120 further includes a plurality of yarn supply nozzles 122 which are respectively installed to the operating rods of the air cylinders 121 and connected to the pressurized air supply device (not shown). One of the yarn supply nozzles 122 is located rear and positioned coaxial with the vertical hole 101 of the bobbin holder 80 of the one carrying member 72 standing by at the yarn supply position 62 of the yarn supply member changing apparatus 60. Similarly, the other of the yarn supply nozzles 122 is located rear and positioned coaxial with the vertical hole 101 of the bobbin holder 80 of the other carrying member 72 standing by at the yarn supply position 62 of the yarn supply member changing apparatus 60. Under simultaneous or independent extension operation of the plural air cylinders 121, the plural yarn supply nozzles 122 are moved simultaneously or independently from their stand-by position indicated by solid lines in FIG. 7 toward their operating position indicated in phantom in FIG. 7. Then, the yarn supply nozzles 122 are simultaneously or independently inserted respectively into the vertical holes 101 of the base plates 82 through the link plates of the carrying member 72 and stopped there. Thereafter, the yarn supply nozzles 122 simultaneously or independently eject air toward the through-holes 5 of the middle plates 4 of the bobbins 2 through the vertical holes 101 of the bobbin holders 80, respectively. Thus, the tip end section of the weft yarn W drawn in the vertical and lateral holes 101, 102 under the action of the suction air stream generating device 100 at the yarn supply position 61 is blown out from the upper end opening 6 of the bobbin 2 toward the weft measuring and storing device 16 through the lateral hole 102, the vertical hole 101 and the through-hole 5 of the middle plate 4. After lapse of a predetermined time within which the tip end section of the weft yarn W is blown out from the bobbin 2 to the weft measuring and storing device 16, the yarn supply nozzle 122 stops its air ejection and is returned to the stand-by position under the contraction operation of the air cylinder 121.

As shown in FIGS. 6 and 7, the empty bobbin and unused bobbin removing device 130 functions to remove simultaneously or independently the empty bobbin 175 or the unused yarn supply member 176 from the plural carrying members 72. More specifically, the empty bobbin and unused bobbin removing device 130 are installed to the frame 64 and located below and near the yarn supply position 62 forming vertically extending members which are disposed generally parallel so that the shaft section 81 of the bobbin holder 80 of each carrying member 72 is located therebetween. With the movement of the carrying member 72, the large diameter bottom surface of the empty bobbin 175 or that of the bobbin 2 of the unused yarn supply member 176 installed on the bobbin holder 80 slides through an inclined guide surface to a generally vertical pushing surface 132. Then, the movement direction of the carrying member 72 is changed through the lower sprockets 74, and therefore the bobbin holder 80 moves in a direction to be extracted from the empty bobbin 175 or the unused yarn supply member 176 with the above movement direction change of the carrying member 72. Thus, the empty bobbin 175 or the unused yarn supply member 176 is brought into contact with the pushing surface 132, so that the empty bobbin 175 or the unused yarn supply member 176 is removed from the bobbin holder 80. Thus, the empty bobbin and unused yarn supply member removing device 130 is arranged to remove the empty bobbin 175 or the unused yarn supply member 176 from the bobbin holder 80 by employing the movement and the movement direction change of the carrying member 72.

As shown in FIGS. 6 and 7, the empty bobbin and unused yarn supply member separating device 140 functions to separate the empty bobbin 175 and the unused yarn supply member 176 removed from the bobbin holder 80 from each other, and to guide and discharge the separated empty bobbin 175 into the empty bobbin temporarily storing device 150 while to guide and discharge the separated unused yarn supply member 176 into a yarn supply member basket (not shown) disposed outside and near the yarn supply member changing apparatus 60. The empty bobbin and unused yarn supply member separating device 140 includes separating members 141 which extend from the lower part of the empty bobbin and unused yarn supply member removing device 130 in a direction far from the frame 64 and obliquely downwardly. The empty bobbin and unused yarn supply member separating device 140 further includes an empty bobbin chute 142 which is connected to the separating members 141 and inclined toward the empty bobbin temporarily storing device 150. The separating members 141 are formed therebetween a dropping space 143 which has a width slightly larger than the outer diameter of the large diameter base end section as shown in FIG. 6. Accordingly, with this empty bobbin and unused yarn supply member removing device 140, the empty bobbin 175 removed from the bobbin holder 80 passes through the dropping space 143 by its own weight and thereafter slides on the empty bobbin chute 142 thereby being discharged to the empty bobbin temporarily storing device 150 as indicated in phantom in FIG. 7, whereas the unused yarn supply member 176 slides on the separating members 141 by its own weight without passing through the dropping space 143.

As shown in FIGS. 6 and 7, the empty bobbin temporarily storing device 150 functions to temporarily store the empty bobbin 175 removed from the bobbin holder 80 at a lower part of the yarn supply member changing apparatus 60, the temporarily stored empty bobbin 175 being thereafter discharged into the empty bobbin holder 170. The empty bobbin temporarily storing device 150 includes a tray 151 installed to the frame 64, and a scraper 152. As shown in FIG. 7, the tray 151 is formed generally H-shaped in cross-section and includes a bottom wall which is located separate from the bottom face of the scraper 152 and vertically intermediate part of the scraper 152, and left and right side walls which are disposed extending in the lateral direction of the frame 64 as shown in FIG. 6. The empty bobbin 175 is mounted on the bottom wall and prevented from dropping by the left and right side walls. As shown in FIG. 7, the scraper 152 is disposed on the bottom wall of the tray 151 and adapted, for example, to be moved from the right side to the left side of the tray 151 by a driving mechanism (not shown) thereby to discharge the empty bobbin 175 from the tray 151 to the empty bobbin basket 170.

The yarn supply member sensor 160 is adapted to detect as to whether the weft supply member 1 is installed on the bobbin holder 80 at the mounting position 61 of the yarn supply changing apparatus 60.

Figure 10:
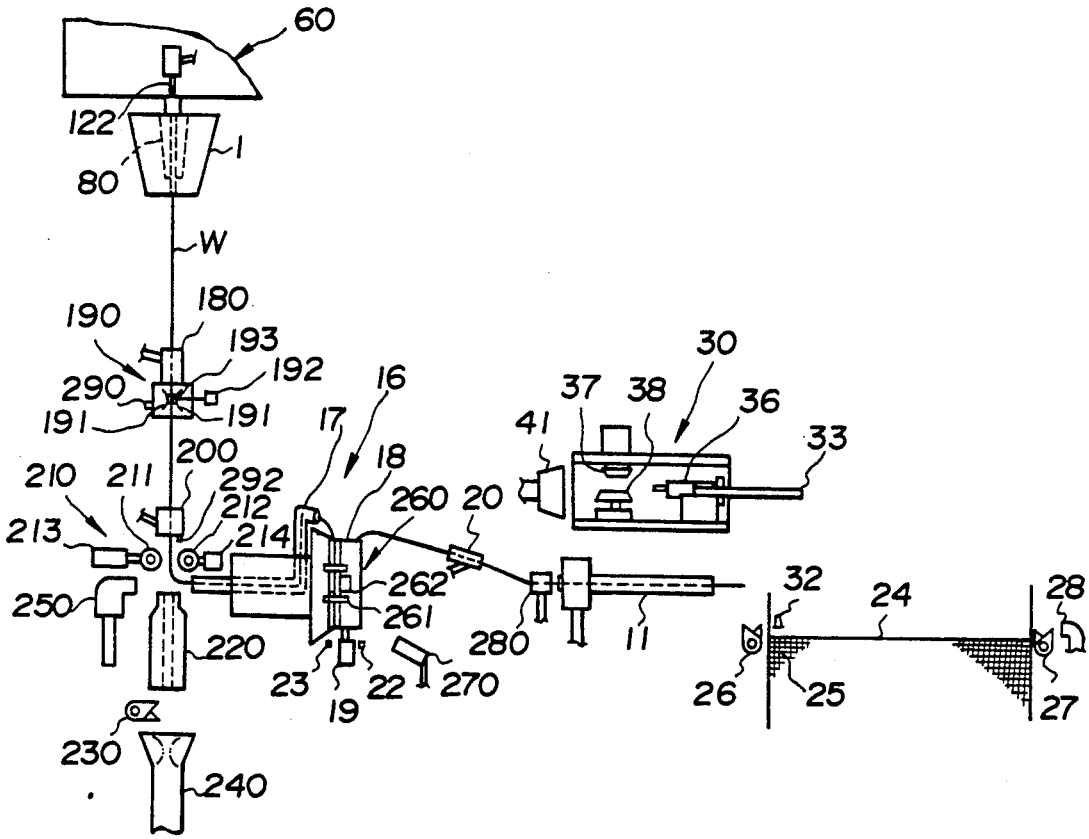
FIG. 10 is a schematic illustration planarly showing a state in which the weft yarn is threaded from the yarn supply member changing apparatus to a loom, in the yarn supply system of FIG. 5.

Explanation of the yarn supply member changing system S will be further made with reference to FIG. 10.

FIG. 10 planarly shows a state in which the weft yarn W of the yarn supply member 1 installed on the bobbin holder 80 of the one carrying member 72 is threaded into the loom 10 at the yarn supply position 62 of the yarn supply member changing apparatus 60. In FIG. 10, a first booster 180 and a tensor 190 are disposed between the yarn supply member changing apparatus 60 and the weft measuring and storing device 16. Disposed near the inlet of the weft winding arm 17 of the weft measuring and storing device 16 are a second booster 200, a gripping device 210, a pipe 220, a cutter 230, a yarn catching 240 and a direction changing nozzle 250. Additionally, a scraping device 260 and a remaining yarn sucking pipe 270 are provided near the periphery of the drum 18 of the weft measuring and storing device 16. Furthermore, a fourth booster 280 is disposed near the inlet of the weft inserting nozzle 11.

The first booster 180 is connected to the pressurized air supply device (not shown) and arranged to eject air from an ejection opening (not shown) formed at an axially intermediate part of the first booster 180 thereby to generate a suction air stream at the inlet side of the first booster 180 and to generate a dragging air stream at the outlet side of the first booster 180. Accordingly, the first booster 180 sucks thereinto the weft yarn W drawn from the yarn supply member 1 at the yarn supply position 62 of the yarn supply member changing apparatus 60 under the influence of the air stream from the yarn ejecting device 120, under the influence of the above-mentioned suction air stream. The thus sucked weft yarn W is dragged to the outlet side of the first booster 180 under the influence of the above-mentioned dragging air stream and introduced toward the downstream side tensor 190.

The above-mentioned tensor 190 has a pair of holding members 191 formed of plate springs, in which the weft yarn W is passed between the holding members 191 so as to be provided with a suitable tension. The holding members 191 are arranged to open and close under the action of a cam 193 connected to a rotary solenoid 192. This tensor 190 is provided with a first weft yarn sensor 290 for detecting the presence and absence of the weft yarn W.

The second booster 200 is connected to the pressurized air supply device (not shown) and arranged to eject air from an ejection opening located at an axially intermediate part of the second booster 200 thereby to generate a suction air stream at the inlet side of the second booster 200 and to generate a dragging air stream at the outlet side of the second booster 200. Accordingly, the weft yarn W from the tensor 190 is sucked into the second booster 200 under the influence of the suction air stream. The thus sucked weft yarn W is dragged to the outlet side of the second booster 200 and introduced to the downstream side gripping device 210. This second booster 200 is provided with a second weft yarn sensor 291 for detecting the presence and absence of the weft yarn W.

The gripping device 210 is arranged as follows: The weft yarn W blown out of the second booster 200 is passed through a space between the peripheral surfaces of a pair of grip rollers 211, 212 which are usually separate from each other. Thereafter, the peripheral surfaces of the respective grip rollers 211, 212 are brought into contact with each other, and then the grip rollers 211, 212 are rotated so as to feed out the weft yarn W upon providing a suitable tension to the weft yarn W. One 211 of these grip rollers is rotatably attached to the operating rod of an air cylinder 213 as an actuator and of the type of rotating upon being driven. The other 212 of these grip rollers is fixed to the output shaft of an electric motor 214 as an actuator and of the type of rotating to drive others.

The pipe 220 is arranged as follows: The weft yarn W blown out of the second booster 200 is introduced into the pipe 220 in a condition in which the grip rollers 211, 212 are separate from each other under the action of the air cylinder 213 of the gripping device 210. Accordingly, the weft yarn W is located traversing the front of the yarn introduction inlet of the weft winding arm 17 of the weft measuring and storing device 16, in a location between the booster 200 and the pipe 220.

The cutter 230 is adapted to cut the tip end section of the weft yarn W projected from the pipe 220 for the purpose of facilitating the transferring of the weft yarn to the weft measuring and storing device 16.

The yarn catching device 240 is arranged to suck and remove a waste yarn cut by the cutter 320.

The direction changing nozzle 250 is connected with the pressurized air supply device (not shown) and arranged to blow the weft yarn W traversing the front of the yarn introduction inlet of the weft winding arm 17, into the yarn introduction inlet of the weft winding arm 17 of the weft measuring and storing device 16 under air ejection therefrom.

The scraping device 260 includes a scraping arm 261 disposed above the drum 18 of the weft measuring and storing device 16. The scraping arm 261 is adapted to be moved in a direction along the axis of the drum 18 under the action of a rotary solenoid 262 as an actuator thereby to remove from the drum 18 the weft yarn W wound on the drum 18.

The remaining yarn sucking pipe 270 is disposed below the drum 18 of the weft measuring and storing device 16 and adapted to suck and remove the weft yarn W scraped out from the drum 18 by the scraping device 260.

The fourth booster 280 is connected to the pressurized air supply device (not shown) and adapted to eject air from an ejection opening (not shown) located at an axially intermediate part of the fourth booster 280 thereby to generate a suction air stream at the inlet side of the fourth booster 290 and to generate a dragging air stream at the outlet of the fourth booster 280. Accordingly, the weft yarn W from the third booster 20 is sucked into the fourth booster 280 under the influence of the above suction air stream, and then the thus sucked weft yarn W is dragged to the outlet side of the fourth booster 280 under the influence of the above dragging air stream so as to be introduced toward the downstream weft inserting nozzle 11.

It will be understood that the loom 10 is of the multiple color type and therefore the number of each of the first booster 180, the tensor 190, the second booster 200, the gripping device 210, the pipe 220, the cutter 230, the yarn catching device 240, the direction changing nozzle 250, the scraping device 260, the remaining yarn sucking pipe 270 and the fourth booster 290 is the same as that of the weft inserting nozzles 11 though only one of them are shown for the purpose of simplicity of illustration.

Next, the manner of operation of the above embodiment yarn supply member changing system of the present invention will be discussed additionally with reference to FIGS. 11 to 15, separately in case (A) that the weft supply member 1 is supplied from the mobile carriage 50 to the yarn supply member changing apparatus 60, and in case (B) that the weft yarn W is supplied from the yarn supply member changing apparatus 60 to the loom 10 owing to using up weft yarn or weft yarn breakage.

(A) In case that the yarn supply member 1 is supplied from the mobile carriage 50 to the yarn supply member changing apparatus 60:

1. First, the yarn supply member sensor 160 disposed at the yarn supply member changing apparatus 60 is always watching the presence and absence of the yarn supply member 1 on the bobbin holder 80. When the weft yarn has been used up or broken in the yarn supply member 1 used in the loom 10, the yarn supply member changing requirement signal is output and therefore the carrying member 72 is moved so that the yarn supply member 1 moves to the yarn supply position 62 of the yarn supply member changing apparatus 60. Thereafter, the weft yarn W is threaded from the yarn supply member 1 to the loom 10. If this threading is failed, the threading is again made. When the threading has been completed, the yarn supply member changing apparatus 60 outputs the yarn supply member supply requirement signal to the watching device in the central control room in case that there is no yarn supply member 1 on the two bobbin holders 80 at the mounting position 61 of the yarn supply member changing apparatus 60. At this time, the locationing of the bobbin holder 80 has been made by the locationing device 90 of the yarn supply member changing apparatus 60.

2. As shown in FIG. 2, in response to the above yarn supply member supply requirement signal, the mobile carrier 50 is moved from the yarn supply member stock area toward the weft supply station 14 at which the yarn supply member changing apparatus 60 requiring supply of the yarn supply member, and stopped at the predetermined stopping position above the yarn supply member changing apparatus 60.
3. The stopped mobile carriage 50 commands an interlock (stopping driving) to the yarn supply member changing apparatus 72 so as to stop the carrying member 72. More specifically, for example, the driving circuit (not shown) of the motor 71 for the carrying device 70 is switched OFF in response to a wireless communication signal output from the mobile carriage 50.
4. As shown in FIG. 3, when movable plate 53 is moved downwardly by the predetermined distance upon the downward driving of the mobile carriage 50 to the movable plate 53, the downward movement of the movable plate 53 is stopped. This causes the yarn supply member 1 to be transferred from the movable plate 53 of the mobile carriage 50 to the bobbin holder 80 standing by at the mounting position 61 of the yarn supply member changing apparatus 60.
5. As shown in FIG. 1, in response to a detection signal (from the yarn supply member sensor 160) representative of presence of the yarn supply member 1, the booster 107 of the suction air stream generating device 100 intermittently eject air a plurality of times thereby to generate the suction air stream at the inlet side of the booster 107 while generating the dragging air stream at the outlet side of the booster 107 (i.e., the suction operation of the booster 107). Accordingly, the tip end section of the weft yarn W of the yarn supply member 1 transferred to the bobbin holder 80 from the movable plate 53 is sucked from the through-hole 5 of the middle plate 4 of the bobbin 2 successively through the vertical hole 101, the lateral hole 102, the through-hole 105 and the through-hole 106, and then sucked in and dragged by the booster 107. Thus, the weft yarn W of the yarn supply member 1 is in a state to be drawn into the bobbin holder 80 upon being engaged with the periphery of the upper end opening 6 of the bobbin 2. When the holding hand 55 of the movable plate 53 is closed a clearance remains between the claw portions 56 and along with the above operation, the movable plate 53 is moved upwardly. Under the upward movement of the movable plate 53, the weft yarn W within the inside piercing hole 3 of the bobbin 2 of the yarn supply member 1 passes through the clearance between the claw portions 56 while the claw portions 56 are withdrawn from the bobbin 2. During withdrawing of the claw portions 56 from the bobbin 2, the suction air stream generating device 100 is arranged such that the booster 107 is in operation to suck air. The timing coincidence between the withdrawing of the claw portions 56 from the bobbin 2 and the suction operation of the booster 107 is such that the weft yarn W is drawn in the passage including the vertical and lateral holes 101, 102 and the through-holes 105, 106 and is not withdrawn out of the bobbin 2 when the claw portions 56 are withdrawn from the bobbin 2. Such a suction operation of the booster 107 may be continuously made; however, the suction operation made intermittently a plurality of times reduces a time within which the weft yarn W is exposed to the suction air stream thereby providing an effect to prevent yarn breakage from arising. Furthermore, a part of the weft yarn W projected from the booster 107 is cut by the cutter 110.

Figure 11:
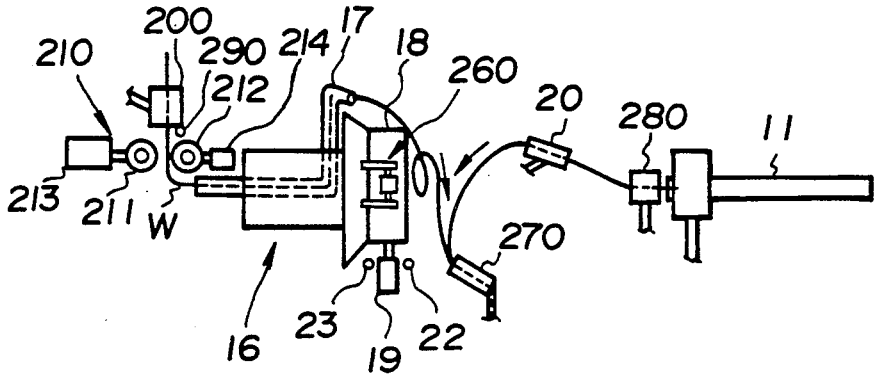
FIG. 11 is a schematic illustration similar to FIG. 10 but showing a state in which the weft yarn is removed from a weft measuring and storing device.
Figure 12:
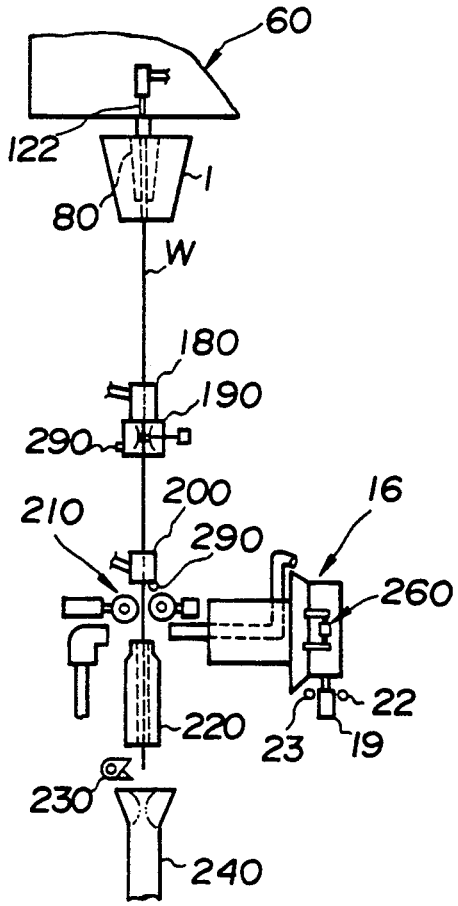
FIG. 12 is a schematic illustration similar to FIG. 10 but showing a state in which the weft yarn is threaded from the yarn supply member changing apparatus to the inlet of the weft measuring and storing device.

(B) In case that the weft yarn W is supplied from the yarn supply member changing apparatus 60 to the loom 10 owing to the weft yarn being used out and the weft yarn breakage:

1. The loom 10 is stopped when the first weft yarn sensor 290 disposed at the tensor 190 detects the absence of the weft yarn upon the weft yarn W of the yarn supply member 1 at the yarn supply position 62 of the yarn supply member changing apparatus 60, or upon the weft yarn W being broken between the yarn supply member changing apparatus 60 and the weft measuring and storing device 16.
2. In response to the yarn supply member changing requirement signal as a weft yarn absence detection signal from the first weft yarn sensor 290, the locationing device 90 of the yarn supply member changing apparatus 60 is driven thereby to release the locationing for the bobbin holder 80.
3. The motor 71 is rotated to make drive in a condition that the electromagnetic clutch 75 of the carrying device 70 makes its OFF operation. After lapse of a predetermined time, the electromagnetic clutch 75 makes its ON operation to move the carrying member 72 so that the yarn supply member 1 installed on the bobbin holder 80 is carried from the side of the mounting position 61 to the yarn supply position 62.
4. The stop position sensor 77 detects the bog (not shown) disposed at the carrying member 72 between the adjacent bobbin holders 80. This causes the electromagnetic clutch 75 to make its Off operation thereby stopping the rotation of the motor 71. After the movement of the carrying member 72 is stopped, the locationing of the bobbin holder 80 is made upon driving the locationing device 90.
5. With the above operations of 2. to 4., as shown in FIG. 11, the scraping device 260 and the remaining yarn sucking pipe 270 are operated, so that the weft yarn W wound on the drum 18 of the weft measuring and storing device 16 is discharged to the side of the weft inserting nozzle 11 with the scraping arm 161 of the scraping device 260, and then the thus discharged weft yarn W is sucked and removed by the remaining yarn sucking pipe 270.
6. After the above operations of 2. to 5., the yarn ejecting device 120 of the yarn supply member changing apparatus 60, the first booster 180, the tensor 190, the second booster 200 and the gripping device 210 are operated or driven as shown in FIG. 12, thereby providing the following operations: Air is ejected from the yarn supply nozzle 121; the pair of holding members 191, 192 of the tensor 190 is operated to take its open state; the suction and dragging air streams are formed in the second booster 200; and the grip roller 211 is separated from the grip roller 212 in the gripping device 210. As a result, the tip end section of the weft yarn W from the yarn supply member 1 at the yarn supply position 61 of the yarn supply member changing apparatus 60 is blown out from the inside of the bobbin 2. Thereafter, the weft yarn W drawn from the yarn supply member 1 is threaded through the first booster 180, the tensor 190, the second booster 200, the pipe 220 and the yarn catching device 240.

Figure 13:
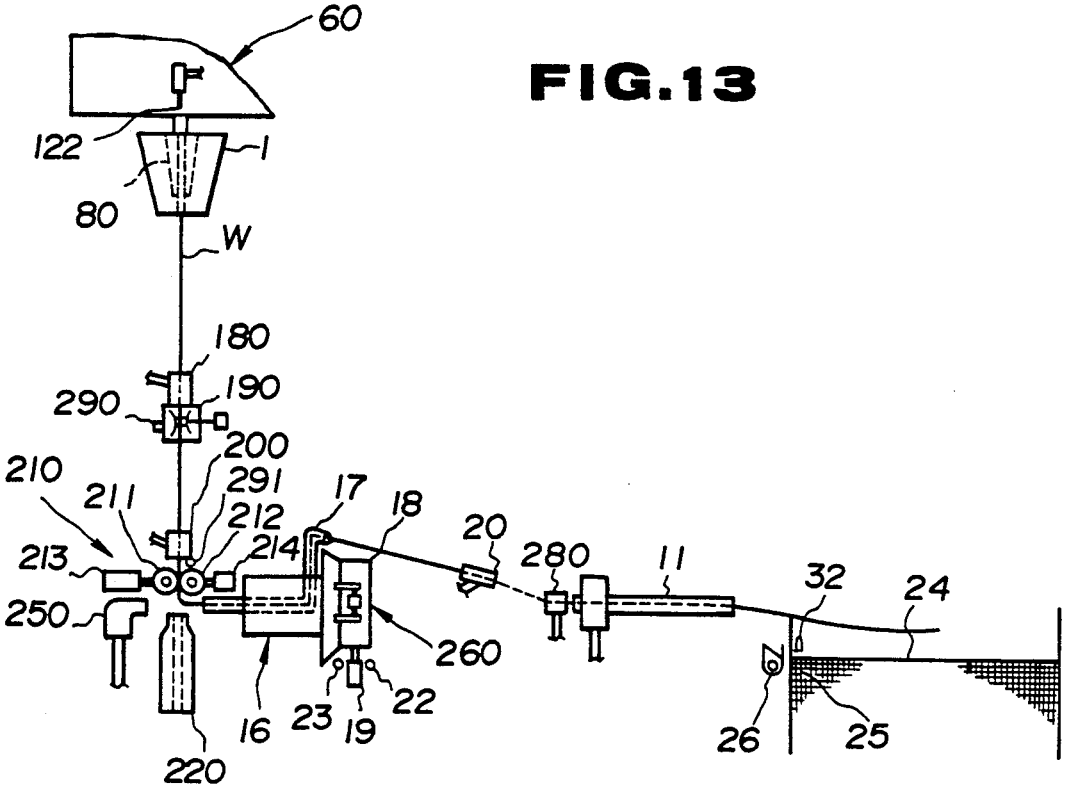
FIG. 13 is a schematic illustration similar to FIG. 10 but showing a state in which the weft yarn is threaded from the yarn supply member changing apparatus to a weft inserting nozzle.
Figure 14:
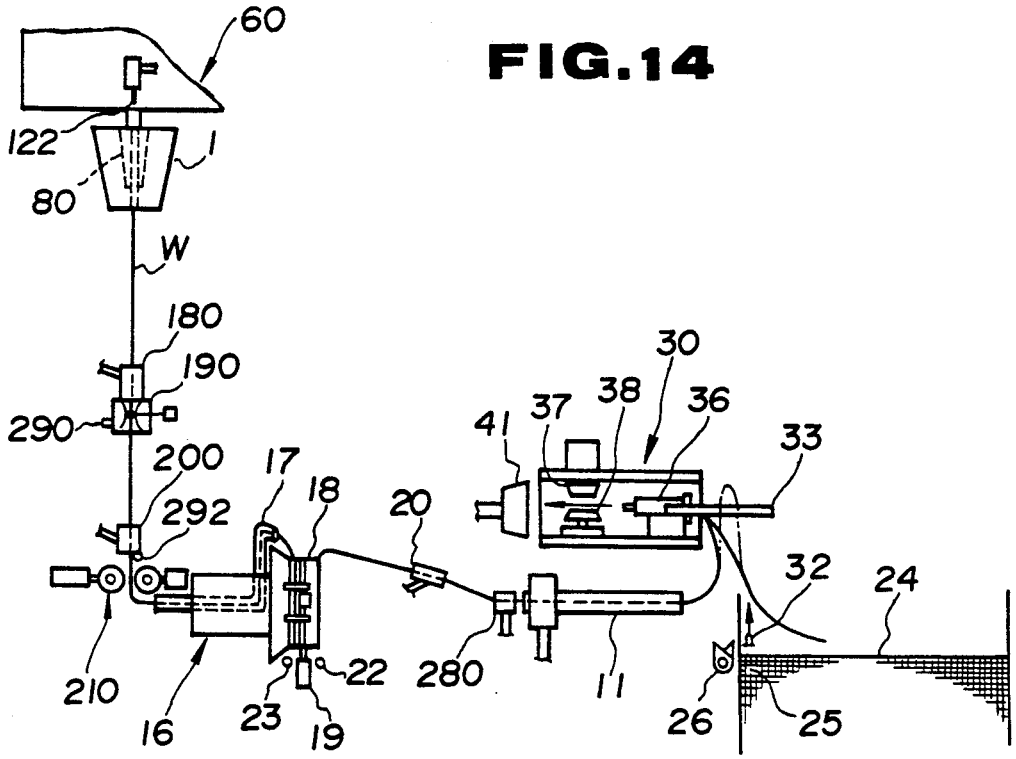
FIG. 14 is a schematic illustration similar to FIG. 10 but showing a state in which the weft yarn threaded from the yarn supply member changing apparatus to the weft inserting nozzle is wound on the drum of the weft measuring and storing device.
Figure 15:
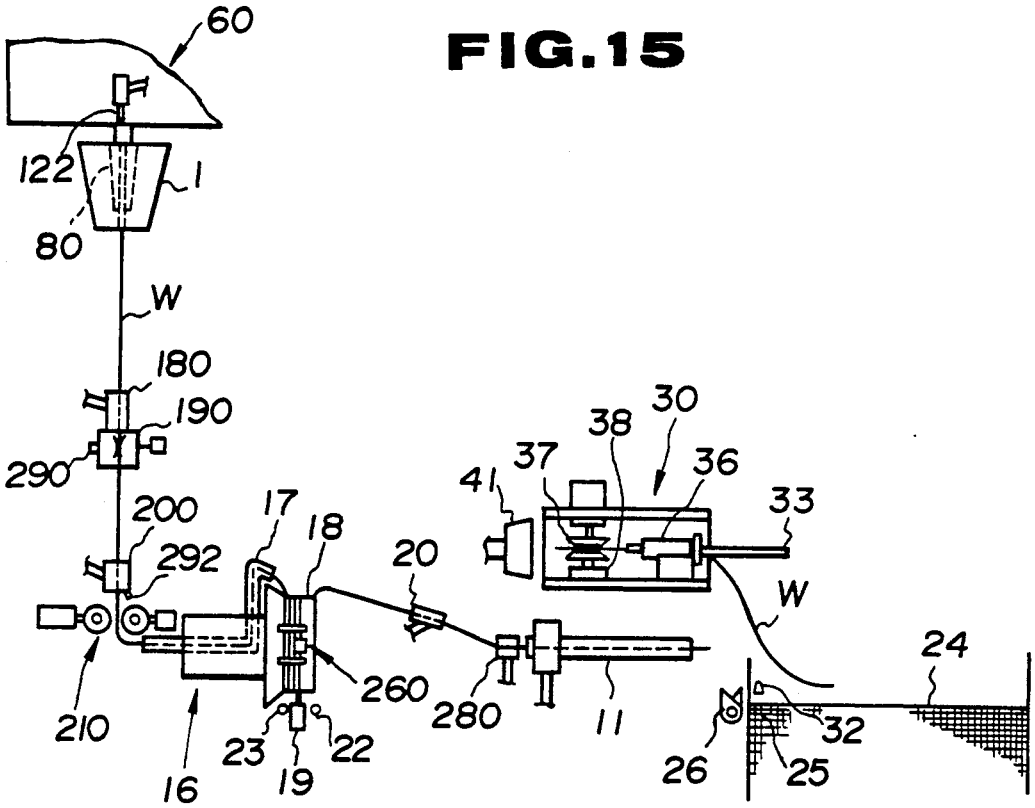
FIG. 15 is a schematic illustration similar to FIG. 10 but showing a state in which the weft yarn threaded through the weft inserting o nozzle and within a warp yarn shed is removed by a dragging and removing device.

7. After the weft yarn W has reached the yarn catching device 240 upon detection of presence of the weft yarn by the second weft yarn sensor 291 disposed at the second booster 200, the operation of the yarn supply nozzle 122, the first and second boosters 180, 200 is stopped and then the cutter 230 cuts the part of the weft yarn W projected from the pipe 220 toward the yarn catching device 240.
8. The air cylinder 213 of the gripping device 210 is operated, and then the grip roller 211 is brought into contact with the grip roller 212, so that the weft yarn W is held between the grip rollers 211, 212.
9. As shown in FIG. 13, the electric motor 214 of the gripping device 210, the direction changing nozzle 250, the third booster 20 and the fourth booster 290 are operated. Additionally, the weft inserting nozzle 11 makes its weak air ejection. Accordingly, the tip end section of the weft yarn W is turned in direction from the inside of the pipe 220 toward the yarn introduction opening of the weft winding arm 17 of the weft measuring and storing device 16, and then drawn into the yarn introduction opening of the weft winding arm 17. Accordingly, the weft yarn W is fed by the grip rollers 211, 212 and threaded through the weft winding arm 17, the third booster 20, the fourth booster 290 and the weft inserting nozzle 11. Thereafter, the weft yarn W is inserted into the warp yarn shed 21 (See FIG. 5), and then the rotational driving of the grip rollers 211, 212 is stopped. The grip roller 211 is separate from the grip roller 212, and then the operation of the direction changing nozzle 250 and the third and fourth boosters 20, 290 is stopped.
10. As shown in FIG. 14, the engaging pin 19 of the weft measuring and storing device 16 is inserted to the drum 18. Then, the weft winding arm 17 is driven to rotate so that the weft yarn W is wound on the drum 18 by a usual predetermined amount under the action of the winding amount sensor 23. Thereafter, the engaging pin 19 is withdrawn from the drum 18, and then the weft yarn W having a length corresponding to 2 turns is unwound under weak ejection of air from the weft inserting nozzle 11. Subsequently, the engaging pin 19 is inserted into the drum 18 so that the weft yarn W is engaged with the engaging pin 19.
11. After the guide arm 33 of the dragging and removing device 30 is moved from the normal stopping position to the preparation stopping position and stopped there, air ejection is made from the blow-up nozzle 32 so that the weft yarn W at a portion between the weft inserting nozzle 11 and the warp yarns Y is blown upwardly forming U-shape. Then, the guide arm 33 is moved from the preparation stopping position to the normal stopping position and stopped there thereby guiding the blown-up weft yarn W to the vicinity of the inlet of the air mover 36. The air mover takes the weft yarn W thereinto under the action of the suction air stream, and then air ejection from the blow-up nozzle 32 is stopped.
12. As shown in FIG. 15, the reed 12 is advanced toward the cloth fell 24, and then the cutter 26 on the weft inserting nozzle side cuts the weft yarn W in the vicinity of the tip end of the weft inserting nozzle 11. With this cutting, the warp yarn side weft yarn W remaining in the warp shed 21 is dragged under the rotational drive of the take-up rollers 37, 38 while being sucked from the inside of the warp yarn shed 21 under the dragging air stream of the air mover 36. Then, the take-up rollers 37, 38 are stopped in their rotational drive and separated from each other, so that the weft yarn W wound on the take-up rollers 37, 38 is discharged out of the dragging and removing device 30 by the suction pipe 41. After the removal of the weft yarn W from the warp yarn shed 21, the operation of the air mover 36 is stopped, and the holding members 191, 192 of the tensor 190 are closed to hold elastically the weft yarn W thereby. As a result, as shown in FIG. 10, threading of the weft yarn W is completed from the new yarn supply member 1 at the yarn supply position 61 of the yarn supply member changing apparatus 60 to the weft inserting nozzle 11 of the loom 10 thereby making possible stating of the loom 10.

Figure 16:
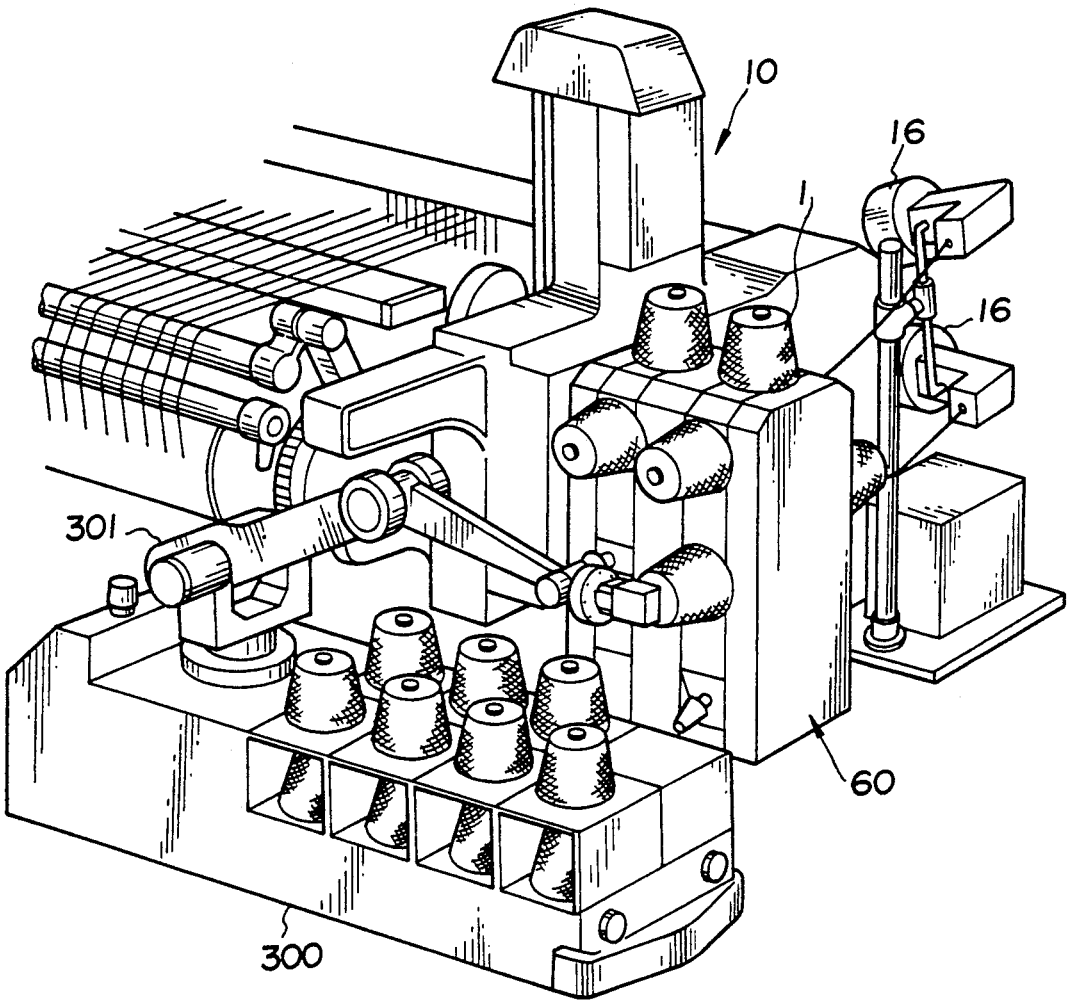
FIG. 16 is a perspective view of a modified example of the yarn supply system of FIG. 5.

While the above embodiment has been shown and described such that supplying the yarn supply member 1 is accomplished by using the mobile carriage 50 moving along the rail 51 disposed on the ceiling and by transferring the yarn supply member 1 to the bobbin holder 80 from a location above the yarn supply member changing apparatus 60, it will be understood that, according to the present invention, the yarn supply member 1 mounted on a self-propelled carriage 300 may be transferred to the bobbin holder 80 from the back side of the yarn supply member changing apparatus 60, the carriage 300 being arranged to run on the floor and provided with a multiple shaft robot 301 mounted on and assembled with the carriage 300 as shown in FIG. 16. In this case, when the yarn supply member 1 is transferred to the bobbin holder 2 with the multiple shaft robot 301, installation of the bobbin 2 of the yarn supply member 1 to the bobbin holder 80 is accomplished upon pressing the bobbin 2 onto the bobbin holder 80 thereby preventing the yarn supply member 1 from falling off.

Figure 17:
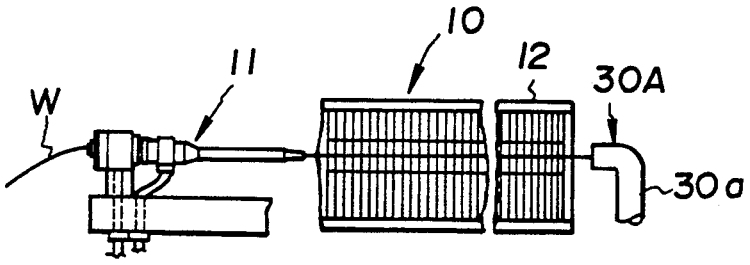
FIG. 17 is a fragmentary front view of a part of another modified example of the yarn supply system of FIG. 5.

Although the yarn supply member changing system S of the present invention has been shown and described as being applied for the loom 10 of the type wherein the dragging and removing device 30 for removing the weft yarn W on the upstream side of the weft inserting nozzle 11 and the mispicked weft yarn is disposed on member changing system S of the present invention may be applied to a loom of the type wherein a similar dragging and removing device 30A is disposed on the counter weft picking side as shown in FIG. 17. In this case, the dragging and removing device 30A is of the suction pipe type and includes a suction pipe 30*a* in which suction is generated to suck the weft yarn W between the weft inserting nozzle 11 and suction pipe 30*a*.

Figure 18A:
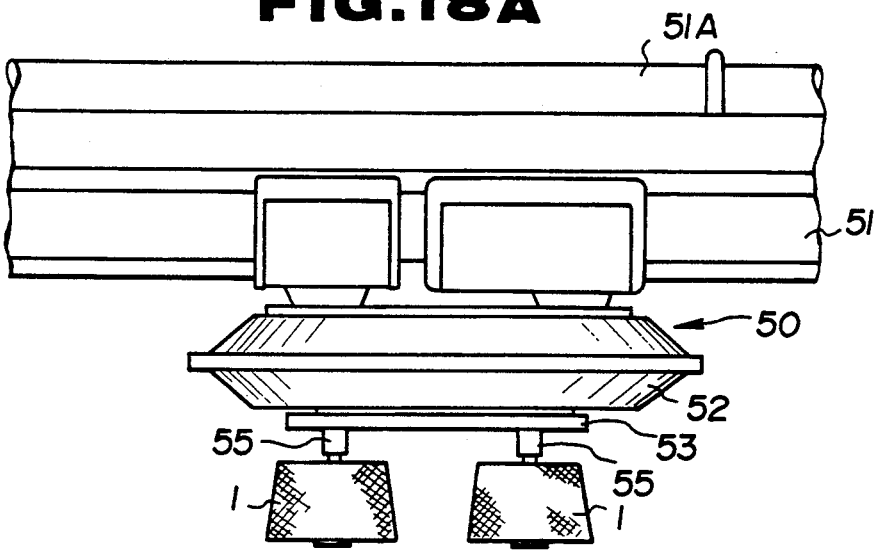
FIG. 18A is a front view showing a modified example of a mobile carriage used in the yarn supply system of FIG. 5.
Figure 18B:
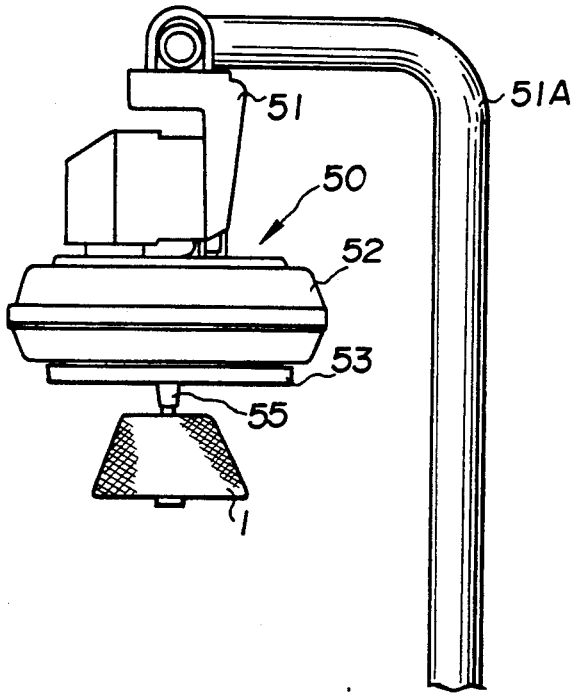
FIG. 18B is a fragmentary side view showing the mobile carriage of FIG. 18A.
Figure 18B:
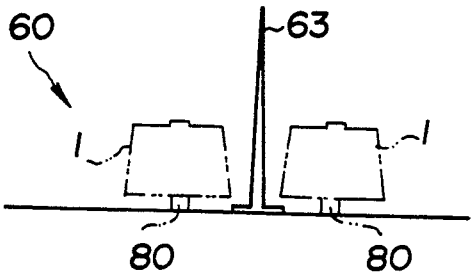
Figure 19:
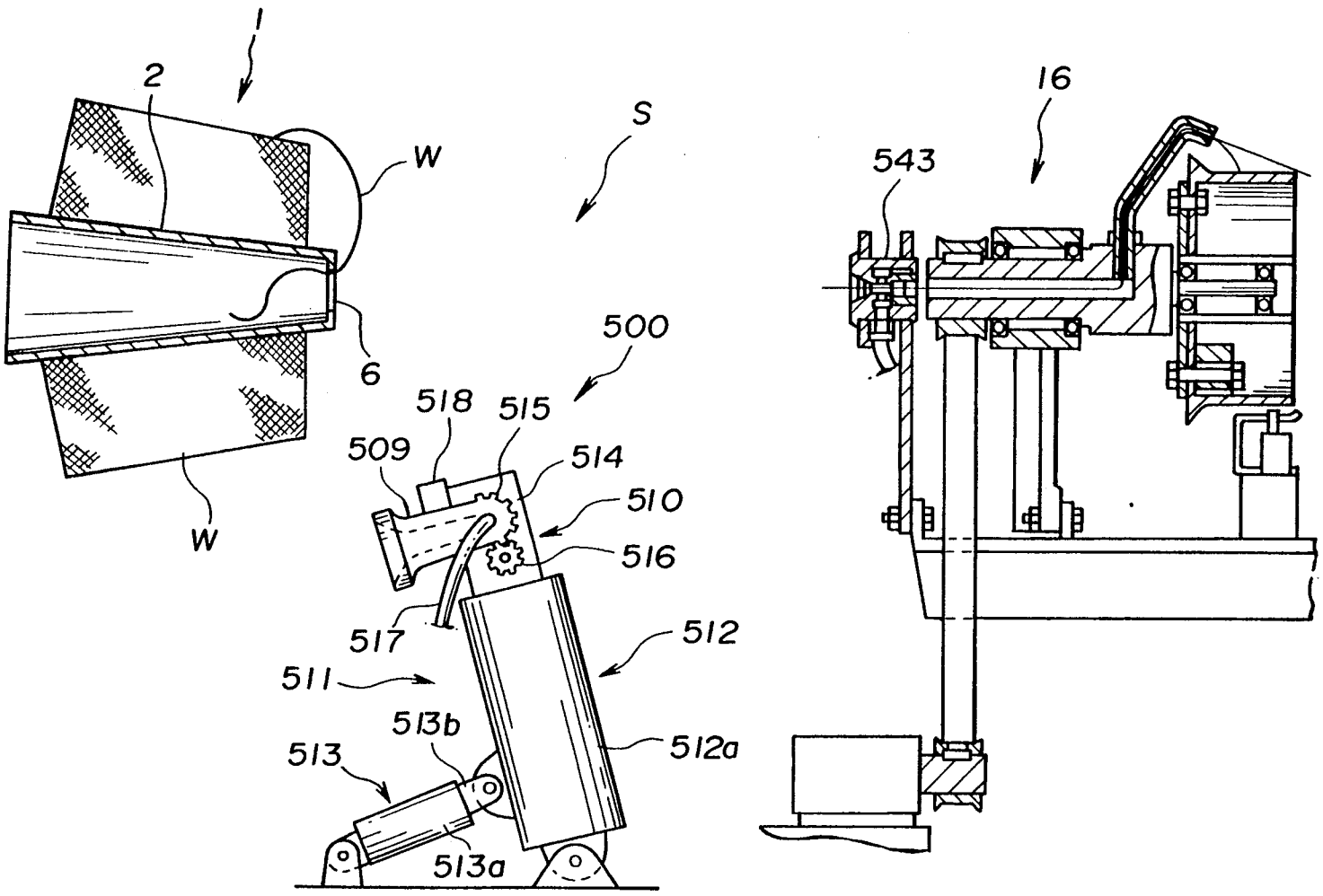
FIGS. 19 to 22 are fragmentary front views, partly in section, of another embodiment of the yarn supply system in accordance with the present invention, showing four operational modes of a transferring device.

FIGS. 18A and 18B show another example of the movable carrier 50 which is substantially the same as that 50 shown in FIG. 5 and slightly modified. The rail 51 is supported upon being suspended from a support structure 51A.

FIGS. 19 to 22 illustrate another embodiment of the yarn supply member changing system S of the present invention, which is similar to the above embodiment except for the provision of a transferring device 500 to ensure the transferring operation of the weft yarn W drawn from the weft supply member 1 to the weft measuring and storing device 16.

As shown in FIGS. 19 to 22, the transferring device 500 includes a keeping member 509 for sucking the tip end section of the weft yarn W and maintains therein. An arm 510 is provided to move the keeping member 509 from the side of the yarn supply member 1 to a nozzle 543 on the side of the weft measuring and storing device 12. Additionally, an operating device 511 is provided to vertically and swingably move the arm 510.

The keeping member 509 is opened at its tip end and is formed of a generally cylindrical member whose open end section is increased in diameter as a trumpet. The keeping member 509 is formed of plastic or the like.

The operating device 511 includes two air cylinder device 512, 513. One air cylinder device 512 has a main body 512*a* which is rotatably supported at its rear end section. The other air cylinder device 513 has a main body 513*a* which is rotatably supported at its rear end section. The tip end section of a piston 513*b* of the air cylinder device 513 is swingably connected to the outer surface of the air cylinder device main body 512*a*. An installation member 514 is connected to the tip end section of the piston rod 512*b* of the air cylinder device 512. The rear end section of the keeping member 509 is rotatably connected to the installation member 514. A driven gear 515 is fixedly secured to the rear end section of the keeping member 509, and engaged with a driving gear 516 which is supported to the installation member 514 and rotated upon being driven by a motor or a rotary solenoid though not shown. Accordingly, the keeping member 509 rotates relative to the installation member 514 upon rotation of the driven gear 515 under rotation of the driven gear 516. A suction pipe 517 communicated with air sucking means (not shown) for sucking air is connected with the rear end section of the above keeping member 509. The suction pipe 517 is communicated with the inside space of the keeping member 509. An air cylinder device 518 is fixedly attached to the outer peripheral surface of the keeping member 509, and has a piston rod 518*a* which is supported by the keeping member 509 in a manner to pass through the wall of the keeping member 509. A weft yarn pressing member 5 19 is fixedly installed to the tip end section of the piston rod 518*a* and located along the inner peripheral surface of the keeping member 509. The weft yarn pressing member 519 is axially movable within the keeping member 509, in which it presses the weft yarn located inside the keeping member 509 at the advancing action of the pressing member 519 thereby to keep the weft yarn.

Figure 20:
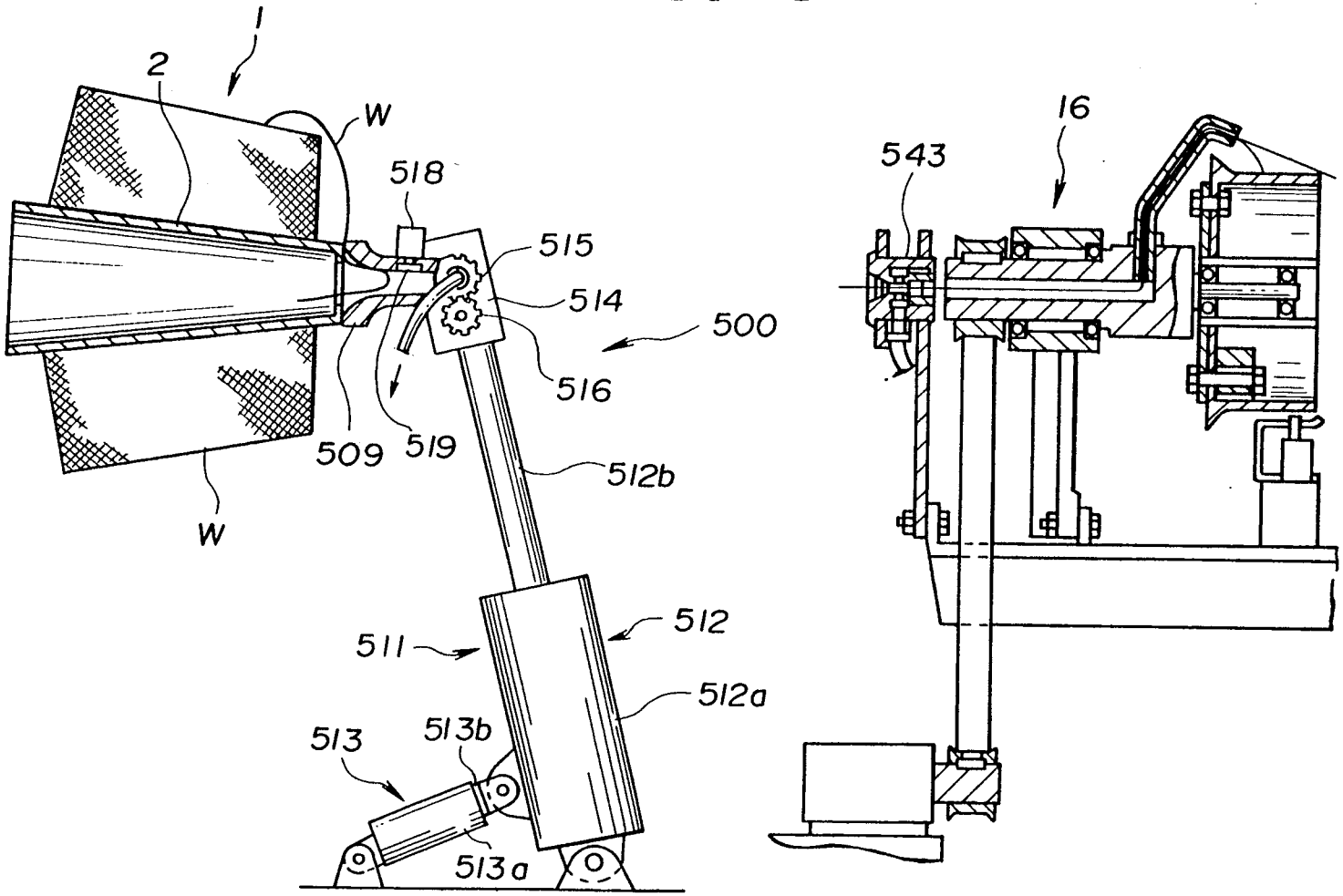

Next, the operation of the above transferring device 500 will be explained. When the piston rod 512*b* is extended upon operating the air cylinder device 512 from the state of FIG. 19, the keeping member 109 moves toward the yarn supply member 1. At a position at which the tip end open section of the keeping member 509 faces the upper end opening 6 of the bobbin 2, the keeping member 509 is rotated so that the tip end open section thereof is pressed onto the upper end opening 6 of the upper end opening 6 of the bobbin 86 as shown in FIG. 20.

Here, when the tip end section of the weft yarn W is drawn under the air ejection as discussed above, the tip end section of the drawn weft yarn W is inserted into the holding member 509. Then, when air is sucked through the suction pipe 517, the tip end section of the weft yarn W is attracted toward the rear end inside the keeping member 109. Here, the weft yarn pressing member 5 19 is moved forward inside the keeping member 509 under the operation of the air cylinder device 518, and pressed onto the tip end section of the weft yarn W located inside the keeping member 509 thereby keeping the weft yarn tip end section.

Figure 21:
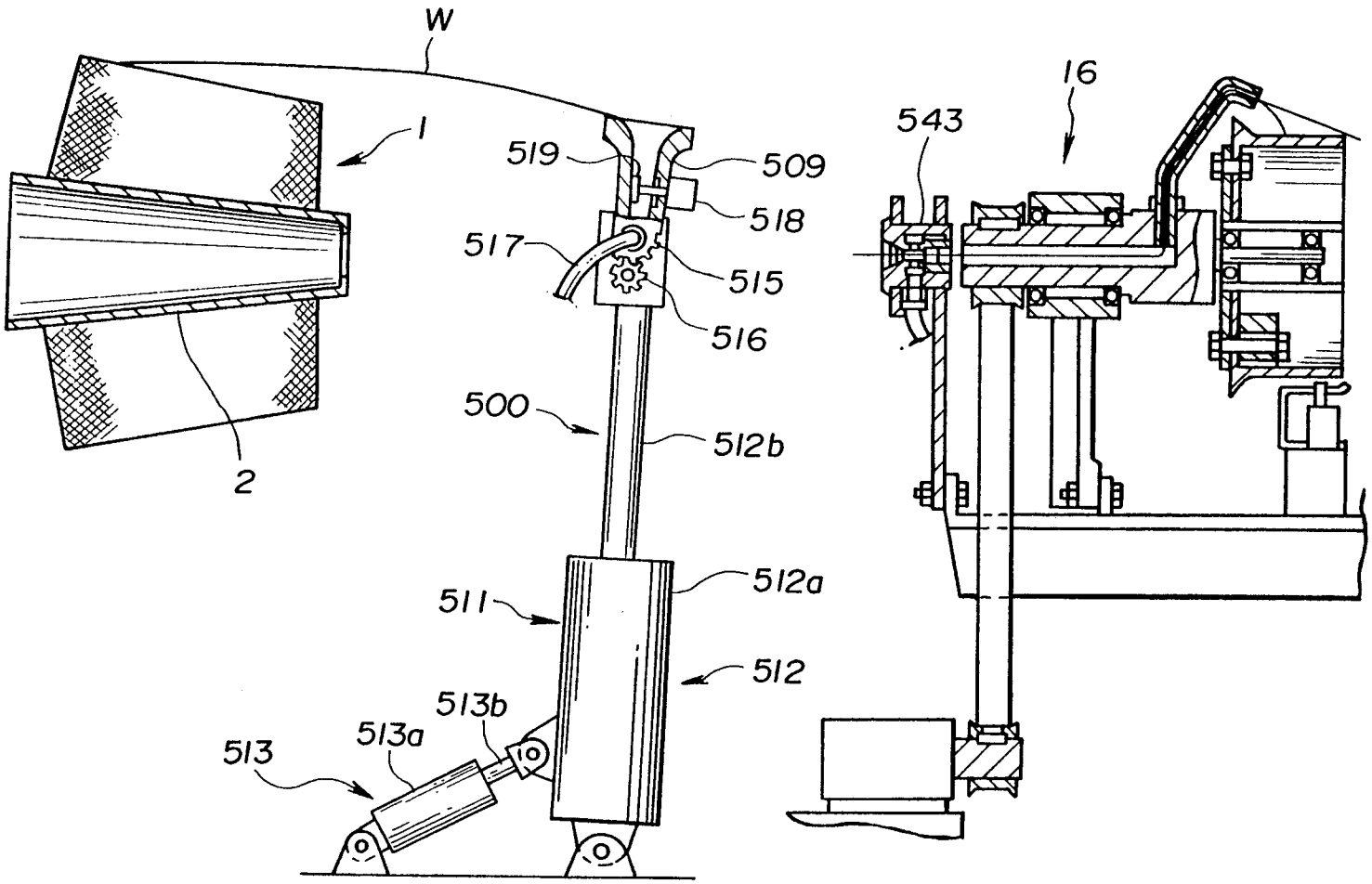
Figure 22:
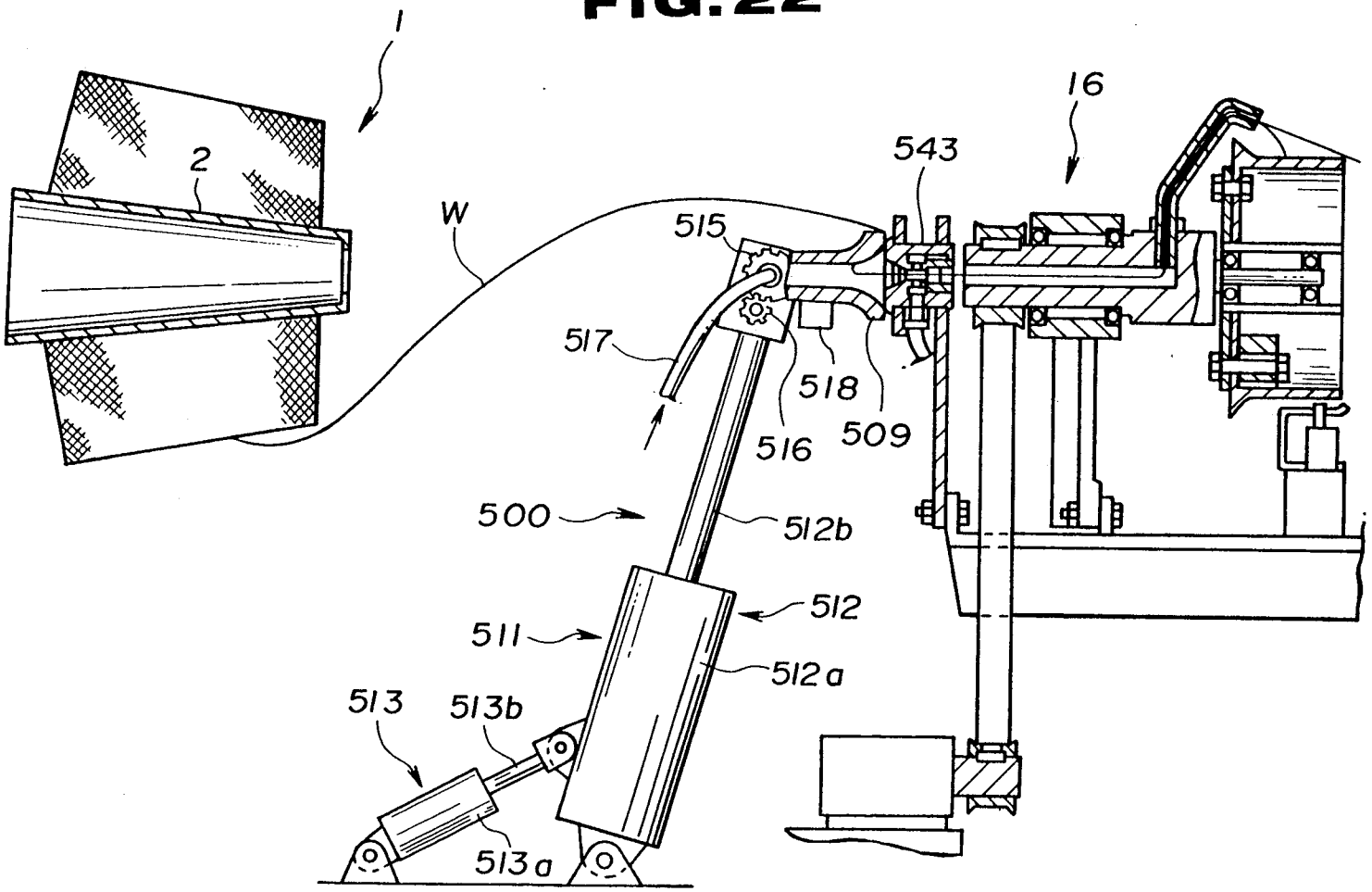

Subsequently, when the air cylinder device 513 is operated to extend its piston rod 513*b*, the air cylinder device 512 swingingly moves as shown in FIG. 21 and therefore the keeping member 509 swingingly moves. Simultaneously, the tip end section of the weft yarn W kept by the keeping member 109 is drawn from the yarn supply member 1. The keeping member 509 moves toward the nozzle 543 and rotated at a position at which the tip end open section of the keeping member 509 faces the weft yarn sucking section of the nozzle 543 as shown in FIG. 22, so that the tip end open section of the keeping member 509 is brought into press contact with the weft yarn sucking section of the nozzle 543.

Then, the weft yarn tip end section is released from its fixation under the pressing member 519. When high pressure air is supplied to the nozzle 543 through a piping 544, the weft yarn tip end section is introduced into the nozzle 543.

According to this embodiment, the weft yarn tip end section drawn from the bobbin 2 is directly transferred to the weft measuring and storing device 16 without causing the weft yarn W to fly.

As discussed above, according to this embodiment, the weft yarn tip end section is first drawn from the yarn supply member under the influence of air stream and then mechanically transferred to the downstream side device forming part of the loom, thereby facilitating and ensuring the transferring operation of the weft yarn from the yarn supply member changing apparatus 60 to the loom side.

Figure 23:
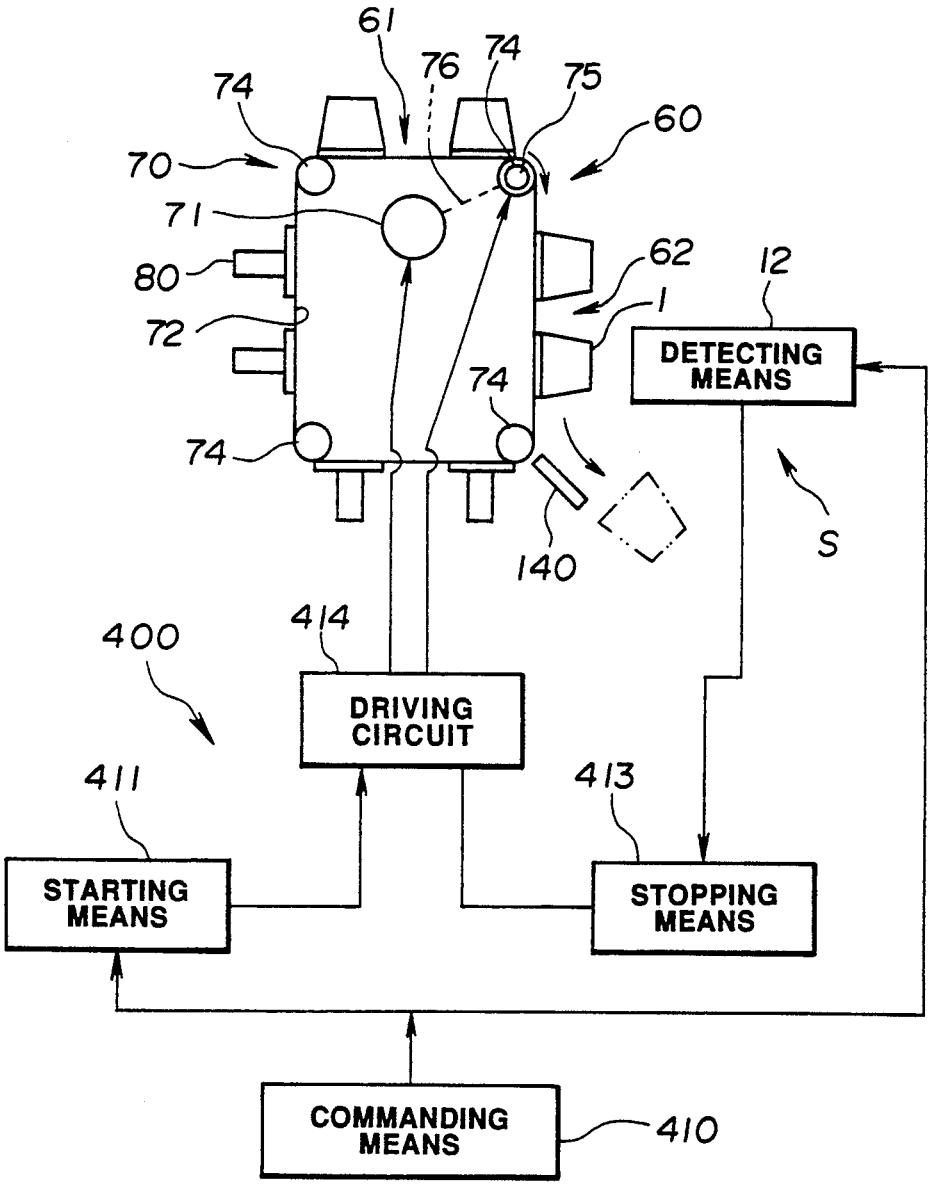
FIG. 23 is a schematic illustration of a further embodiment of the yarn supply system in accordance with the present invention.
Figure 24:
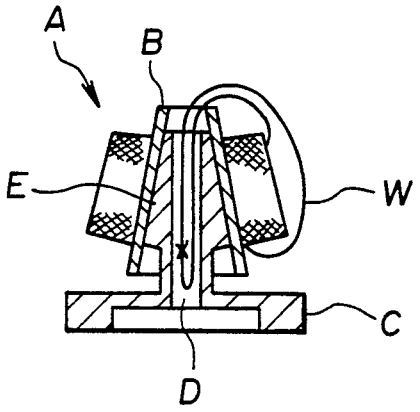
FIG. 24 (PRIOR ART)
FIG. 24 is a vertical sectional view of a yarn supply member with a tray, used in a conventional yarn supply system.
Figure 25:
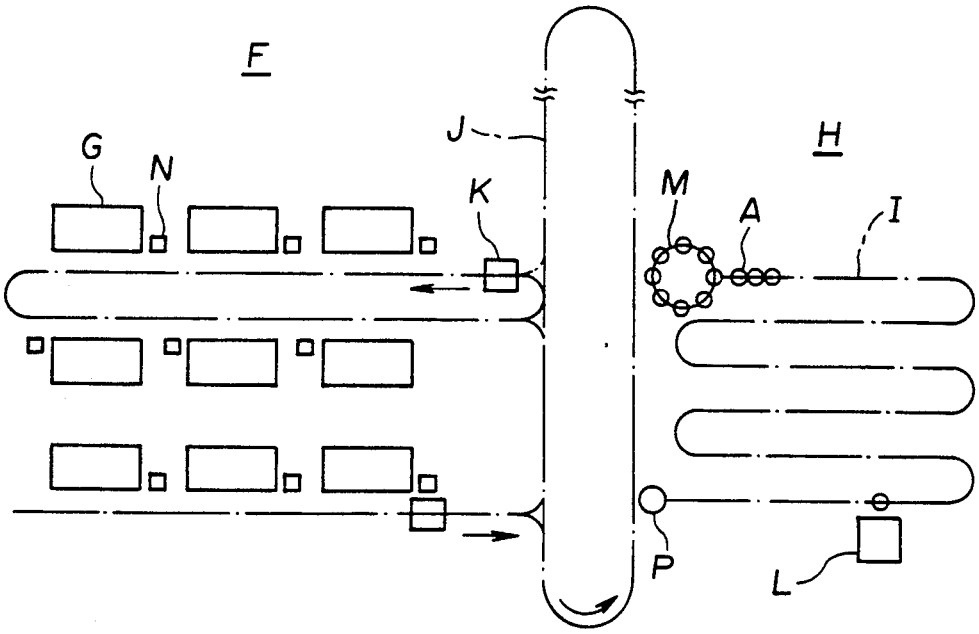
FIG. 25 (PRIOR ART)
FIG. 25 is a schematic plan view illustrating the conventional yarn supply system of FIG. 24.

FIG. 23 illustrates another embodiment of the yarn supply member changing system according to the present invention, which is similar to the above embodiment of FIGS. 1 to 15 except for provision of a control system 400 for controlling changing of kind of a fabric to be woven by the loom 10 under removal of the yarn supply members on the yarn supply member changing apparatus 60. It is to be noted that recently it is required to change the kind of the woven fabric by interrupting a previously set production scheme in a weaving factory, owing to a fashionable trend of woven fabric, shortening of the fashionable trend, diversification of consumer's fondness to woven fabric.

Referring to FIG. 23, the control system 400 includes commanding means 410 for outputting a signal commanding changing the kind of the woven fabric or removal of the yarn supply members from the carrying devices 70 of the yarn supply member changing apparatus 60. Starting means 411 is provided to output a driving signal for driving the carrying device 70, through a driving circuit 314, in response to the kind changing commanding signal from the commanding means 410. Detecting means 412 of the non-contact type such as the type of sensing reflected light is provided to detect the presence and absence of the yarn supply member remaining at the yarn supply position 62 on the carrying device 70, in response to the kind changing commanding signal from the commanding means 410. Additionally, stopping means 413 is provided to output a drive stopping signal for stopping the driven movement of the carrying device 70 in response to a signal representative of the absence of the remaining yarn supply member, from the detecting means 412. A driving circuit 414 for the motor 71 and the electromagnetic clutch 75 makes their ON operation in response to the driving signal from the starting means 411 while their OFF operation in response to the drive stopping signal from the stopping means 313. It will be understood that at least a part of the control system 400 constitutes a part of a microcomputer mounted on the loom.

According to this embodiment, when the commanding means 410 outputs the kind changing commanding signal according to a command from the watching device in the central control room (not shown) or an operator's operation, the driving means 411 outputs the driving signal to the driving circuit 414. In response to the driving signal from the staring means 411, the driving circuit 414 causes the motor 71 to be supplied with electric power while the electromagnetic clutch 75 to make its ON operation. As a result, the carrying member 72 is rotatingly driven in a direction of an arrow shown in FIG. 23. Under this driving of the carrying member 72, the yarn supply member 1 remaining on the carrying member 72 upon being mounted on the bobbin holder 80 is moved from side of the mounting position 61 to the side of the yarn supply position 62. Immediately after the yarn supply member 1 passes the yarn supply position 62, it is automatically removed as indicated in phantom in FIG. 23 from the bobbin holder 80 of the carrying device 70 by the empty bobbin and unused yarn supply member removing device 140. In the course of this operation, the detecting means 412 upon receiving the kind changing commanding signal from the commanding means 410 detects the presence and absence of the yarn supply member 1 passing through a position between the yarn supply position 62 and the empty bobbin and unused yarn supply member removing device 140. When the detecting means 412 detects the absence of the remaining yarn supply member on the carrying member 72, it outputs the signal representative of the absence of the yarn supply member, to the stopping means 313. Upon receiving this yarn supply member absence signal from the detecting means 412, the stopping means 431 outputs the drive stopping signal to the driving circuit 414. Then, the drive circuit 314 interrupts electric power supply to the electromagnetic clutch 75 and the motor 71. As a result, the electromagnetic clutch 75 makes its OFF operation while stopping the drive rotation of the motor 71, so that the movement of the carrying member 72 is stopped thus stopping the driving operation of the carrying device 70.

Thus, according to this embodiment, the yarn supply members remaining on the carrying device can be automatically removed by artificially outputting the yarn supply member removing signal (or the woven fabric kind changing commanding signal) in order to change the kind of woven fabric. Hence, weaving a new kind of fabric can be smoothly started even in case that changing woven fabric kind is required upon interrupting the previously set production scheme.

What is claimed is:

1. A yarn supply system in combination with a loom, comprising:

a yarn supply member including a hollow core member on which a weft yarn is wound, and a middle plate fixedly disposed inside said hollow core member to divide the inside of said hollow core member into first and second chambers along an axial direction of said hollow core member, the weft yarn having a tip end section which is stored in said first chamber, said middle plate being formed with a through-hole through which said first and second chambers are in communication with each other;

a stand member for supporting said yarn supply member at a yarn supply station; and first means for generating an air stream and for supplying the air stream into said first chamber and through said through-hole of said middle plate, said air stream drawing out the weft yarn tip end section stored inside said hollow core member and transferring the weft yarn tip end section to a downstream side device forming part of the loom.

2. A yarn supply system as claimed in claim 1, further comprising a bobbin holder on which said hollow core member of said yarn supply member is to be mounted, said bobbin holder being disposed on said stand member, and second means for generating an air stream in said bobbin holder to suck the weft yarn from the inside of said hollow core member into said bobbin holder when said hollow core member is mounted on said bobbin holder.

3. A yarn supply system as claimed in claim 2, wherein said second air stream generating means further includes means for generating the air stream in the bobbin holder in a hole formed in said bobbin holder to suck said weft yarn into said hole.

4. A yarn supply system as claimed in claim 3, wherein said hole in said bobbin holder serves as a passage through which the weft yarn tip end section is transferred from said yarn supply member hollow core member toward the downstream side device.

5. A yarn supply system as claimed in claim 1, further comprising a plurality of bobbin holders disposed on said stand member, said bobbin holders including a first bobbin holder on which the hollow core member of the yarn supply member from which said weft yarn is presently being supplied to the loom is mounted, and second bobbin holders on which the core members of spare yarn supply members are respectively mounted; and carrying means for moving said bobbin holders from a stand-by position to a used position.

6. A yarn supply system as claimed in claim 5, wherein said carrying means includes a plurality of carrying devices for moving said bobbin holders from their stand-by position to their used position, a plurality of weft yarns from said respective weft supply members corresponding to said carrying devices being threaded to the loom which is a multiple color loom, and clutch means for establishing and interrupting transmission of power of a single driving power source to each of said carrying devices.

7. A yarn supply system as claimed in claim 5, further comprising means for detecting said yarn supply member on said bobbin holder and at said stand-by position, said detecting means being provided to said stand member, said detecting means being adapted to output a yarn supply member supply requirement signal when detecting absence of said yarn supply member at a predetermined timing.

8. A yarn supply system as claimed in claim 5, wherein said carrying means includes a carrying member which is adapted to move said yarn supply member to a removing position which is located downstream of said used position in movement of said carrying member, wherein said yarn supply system further comprises means for removing said yarn supply member from said bobbin holder at said removing position.

9. A yarn supply system as claimed in claim 8, further comprising means for causing said carrying member to move in response to a yarn supply member removing signal, so that said yarn supply members mounted on said bobbin holders and remaining on said carrying member are moved to said removing position to remove said yarn supply members by said yarn supply member removing means.

10. A yarn supply system as claimed in claim 8, wherein said yarn supply member removing means includes a member disposed near said carrying member to push said yarn supply member at a rear end as said carrying member moves.

11. A yarn supply system as claimed in claim 8, further comprising a tray for receiving said yarn supply member removed by said yarn supply member removing means, and a scraper for scraping said yarn supply member in said tray remote from said stand member.

12. A yarn supply system as claimed in claim 8, further comprising means for separating said yarn supply members into empty core members and unused yarn supply members when said yarn supply members are removed at said removing position by said yarn supply member removing means.

13. A yarn supply system as claimed in claim 1, wherein said first air stream generating means includes means for ejecting air through the inside of said hollow core member.

14. A yarn supply system as claimed in claim 1, wherein said first air stream generating means includes an arm member which is movable between said yarn supply member supported by said stand and said downstream side device.

15. A yarn supply system as claimed in claim 1, wherein said middle plate is perpendicular to an axis of said hollow core member.

16. A yarn supply system as claimed in claim 1, wherein a part of said stand member is located in said second chamber of said hollow core member.

17. An apparatus comprising:

a loom having a downstream side device;

a yarn supply member including a hollow core member on which a weft yarn is wound, and a middle plate fixedly disposed inside said hollow core member to divide the inside of said hollow core member into first and second chambers along an axial direction of said hollow core member, the weft yarn having a tip end section which is stored in said first chamber, said middle plate being formed with a through-hole through which said first and second chambers are in communication with each other;

a stand member for supporting said yarn supply member at a yarn supply station;

first means for generating an air stream and for supplying the air stream into said first chamber and through said through-hole of said middle plate, said air stream drawing out the weft yarn tip end section stored inside said hollow core member and transferring the weft yarn tip end section to a downstream side device forming part of the loom;

a bobbin holder on which said hollow core member of said yarn supply member is to be mounted, said bobbin holder being disposed on said stand member; and second means for generating an air stream in said bobbin holder to suck the weft yarn from the inside of said hollow core member into said bobbin holder when said hollow core member is mounted on said bobbin holder.

18. An apparatus comprising:

a loom having a downstream side device;

a stand member for supporting at a yarn supply station a yarn supply member which includes a hollow core member, wherein a tip end section of a weft yarn is wound on the hollow core member and is stored in the hollow of said hollow core member;

means for generating an air stream which draws the weft yarn tip end section out of said hollow core member and transfers the weft yarn tip end section to said downstream side device forming part of the loom;

a plurality of bobbin holders disposed on said stand member, said bobbin holders including a first bobbin holder on which the hollow core member of the yarn supply member from which said weft yarn is presently being supplied to the loom is mounted, and second bobbin holders on which the core members of spare yarn supply members are respectively mounted; and carrying means for moving said bobbin holders from a stand-by position to a used position.

19. An apparatus comprising:

a loom having a downstream side device;

a stand member for supporting at a yarn supply station a yarn supply member which includes a hollow core member, wherein a tip end section of a weft yarn is wound on the hollow core member and is stored in the hollow of said hollow core member; and means for generating an air stream which draws the weft yarn tip end section out of said hollow core member and transfers the weft yarn tip end section to said downstream side device forming part of the loom;

wherein said weft yarn tip end section drawing and transferring means includes an arm member which is moveable between said yarn supply member supported by said stand and said downstream side device.

* * * * *